US010512827B1

(12) United States Patent
Hobbs et al.

(10) Patent No.: US 10,512,827 B1
(45) Date of Patent: Dec. 24, 2019

(54) GOLF CLUB HEAD WITH A HOLLOW RAIL

(71) Applicant: Cobra Golf Incorporated, Carlsbad, CA (US)

(72) Inventors: Bryce Hobbs, Carlsbad, CA (US); D. Clayton Evans, San Marcos, CA (US); Cameron J. Day, Vista, CA (US); Tim A. Beno, San Diego, CA (US); Ryan L. Roach, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 16/189,632

(22) Filed: Nov. 13, 2018

(51) Int. Cl.
*A63B 53/04* (2015.01)
*A63B 53/06* (2015.01)

(52) U.S. Cl.
CPC .. *A63B 53/0466* (2013.01); *A63B 2053/0433* (2013.01); *A63B 2053/0491* (2013.01)

(58) Field of Classification Search
USPC ..... 473/324–350
See application file for complete search history.

(56) References Cited

U.S. PATENT DOCUMENTS 5,213,329 A * 5/1993 Okumoto ..... A63B 53/04 473/328
5,456,469 A * 10/1995 MacDougall ..... A63B 53/04 473/328
6,056,649 A * 5/2000 Imai ..... A63B 53/04 473/328
6,123,627 A * 9/2000 Antonious ..... A63B 53/04 473/327
6,663,503 B1 * 12/2003 Kenmi ..... A63B 53/04 473/328
7,115,047 B2 * 10/2006 Stevens ..... A63B 53/02 473/334
7,121,955 B2 * 10/2006 Stevens ..... A63B 53/02 473/334
7,404,772 B2 * 7/2008 Koide ..... A63B 53/007 473/334
7,452,286 B2 * 11/2008 Lin ..... A63B 53/0466 473/334
7,462,110 B2 * 12/2008 Yamamoto ..... A63B 53/0466 473/334

(Continued)

FOREIGN PATENT DOCUMENTS

EP 927563 A2 * 7/1999
JP 07163685 A * 6/1995 ..... A63B 53/0466

(Continued)

*Primary Examiner* — Alvin A Hunter
(74) *Attorney, Agent, or Firm* — Quarles & Brady LLP

(57) ABSTRACT

A golf club head with at least one hollow rail disposed on the sole of the club head body, and an insert positioned within at least a portion of the at least one hollow rail. The insert may include a thermoplastic polymer, such as thermoplastic urethane, and may be positioned to beneficially modify a mass distribution of the club head. By providing sole rail(s), a player may benefit from improved ball speed due to the improved interaction between the club head and turf or ground. The golf club head may further include a channel along a length of the sole of the club head, wherein the channel traverses the at least one hollow rail. The channel may extend in a heel-toe direction along the sole and allow greater flexibility in the club head upon impact with a golf ball.

3 Claims, 17 Drawing Sheets

(56) References Cited

U.S. PATENT DOCUMENTS

| | | | | |
|---|---|---|---|---|
| 7,806,782 | B2 * | 10/2010 | Stites | A63B 53/0466 473/334 |
| 8,016,694 | B2 * | 9/2011 | Llewellyn | A63B 53/0466 473/334 |
| 8,202,175 | B2 * | 6/2012 | Ban | A63B 53/0466 473/338 |
| 8,435,135 | B2 * | 5/2013 | Stites | A63B 53/0466 473/334 |
| 8,721,471 | B2 * | 5/2014 | Albertsen | A63B 53/0466 473/328 |
| 9,089,748 | B2 * | 7/2015 | Morales | A63B 53/0466 |
| 9,238,162 | B2 * | 1/2016 | Breier | A63B 53/0466 |
| 9,381,410 | B2 * | 7/2016 | Golden | A63B 53/0466 |
| 9,421,433 | B2 * | 8/2016 | Martens | A63B 53/0466 |
| 9,597,563 | B2 * | 3/2017 | Voshall | A63B 53/06 |
| 10,022,599 | B1 * | 7/2018 | Jorgensen | A63B 53/0466 |
| 10,035,051 | B2 * | 7/2018 | Cleghorn | A63B 53/0466 |
| 10,076,688 | B1 * | 9/2018 | Harbert | A63B 53/0466 |
| 10,137,342 | B2 * | 11/2018 | Hebreo | A63B 53/06 |
| 2004/0121852 | A1 * | 6/2004 | Tsurumaki | A63B 53/0466 473/344 |
| 2004/0192463 | A1 * | 9/2004 | Tsurumaki | A63B 53/0466 473/329 |
| 2006/0094526 | A1 * | 5/2006 | Reed | A63B 53/04 473/328 |
| 2008/0153623 | A1 * | 6/2008 | Ines | A63B 53/0487 473/340 |

FOREIGN PATENT DOCUMENTS

| | | | | |
|---|---|---|---|---|
| JP | 11262548 A | * | 9/1999 | A63B 53/04 |
| JP | 2008149111 A | * | 7/2008 | A63B 53/047 |

* cited by examiner

GOLF CLUB HEAD WITH A HOLLOW RAIL

TECHNICAL FIELD

The disclosure relates to a golf club head with hollow rails.

BACKGROUND

Golf courses challenge golfers to adapt and successfully play through various types of terrain between the tee box and the hole. The fairway, the area between the tee box and the putting green, often has short, evenly-cut grass. In contrast, the rough refers to areas between the fairway and the out-of-bound markers, as well as areas between a mowed apron surrounding the green and out of bounds areas. Grass in the rough is high and coarse, making the rough a difficult area from which to hit. The distance and direction a golf ball travels after being hit is significantly impacted by the contact between the sole of the club head and the ground, which is influenced by terrain type. For example, when striking a golf ball from the rough, contact between the grass and the club head slows the golfer's swing speed and often causes the club head to twist prior to impact resulting in off-centered shots.

Certain approaches to helping the golfer hit the ball in the intended direction for the desired distance have produced golf clubs with larger striking faces. By having a larger striking face, a greater contact area between the ball and the club head is provided. The thought is that a club with a larger striking face will move in a straighter line along the swing plane, projecting the golf ball in a straight direction. However, these clubs do not necessarily resist twisting, and certain types of terrain continue to disrupt the club head prior to contact with the ball, resulting in off-centered shots that propel the golf ball in unintended directions for undesirable distances. Such unpredictable results do not accurately reflect the golfer's skill or strategy for a given shot, which hinders the golfer's skill development.

SUMMARY

The present disclosure provides a golf club head with at least one hollow rail disposed on the sole of the club head body, and an insert provided within at least a portion of the at least one hollow rail. The at least one hollow rail protrudes from the sole of the club head, thereby providing improved ball speed due to a stabilizing interaction between the club head and turf or ground. The stabilized turf interaction helps shots that are hit from the rough to fly straight. The at least one hollow rail is partially hollow and may include or be filled with any suitable materials, such as metals, alloys, polymers, plastics, composites or other fillers. Thus, at least the composition, position, and orientation of the at least one hollow rail in combination with inserts may be varied to optimize the turf interaction of the club head, among many features. For example, the insert may include a thermoplastic polymer and may be positioned to adjust a mass distribution of the club head. The stabilized turf interaction helps keep the club face straight and helps the player maintain accuracy and club speed through the swing when playing on certain types of terrain. Improved club speed may provide a player with improved distance and a more favorable lie depending on the length to the hole and terrain presented in a shot.

The use of a low-density thermoplastic material in the insert allows discretionary mass to be "freed up" and such mass may be advantageously distributed throughout other parts of the club head. Similarly, by providing the club head with at least one hollow rail having less mass than a solid rail, discretionary mass saved may be advantageously distributed throughout other parts of the club head. The discretionary mass may be positioned elsewhere in the club head to optimize mass distribution or apply structure to portions of the club head. For example, an adjustable mass may be positioned in the club head to adjust the club head's center of gravity or mass distribution. Adjusting the center of gravity or mass distribution may allow the club head to exhibit a high rotational moment of inertia about a vertical axis, reducing the likelihood of twisting upon contact with the terrain or ground. In another example, a support member such as a support rib or struts may be provided to further increase the rigidity of the club head structure. The insert may also be designed to modify the vibrating frequency, resonance, volume, or timbre of sound resulting from impact between the club head and a golf ball. For example, the insert may be designed such that a consistent sound is received upon accurate contact.

When a shot is made from the rough, the hollow rail protruding from the sole of the club head decreases friction upon the club head by providing a smaller surface area in contact with the rough, as compared to the entire sole or greater portions of the sole. The at least one hollow rail may extend along a length of the sole from a forward portion of the sole proximal to the ball striking face to an aft portion of the sole distal to the ball striking face. Accordingly, upon contact with the rough, the at least one hollow rail may also assist the club head in cutting or passing through at least a part of the rough, decreasing friction upon the club head as well as resisting twisting prior to impact with a golf ball. By providing the golfer with such advantages and a smoother, more consistent shot in the rough, a club head of the invention allows the golfer to play better, achieve a better score, and realize greater value from the golfing experience.

In some embodiments, the club head is provided with at least two hollow rails. In certain examples, the at least two hollow rails may be substantially parallel to each other, curved or inclined inward toward each other, away from each other, or in varying directions. The at least two hollow rails may be spaced apart by approximately 1 cm to 7 cm, or greater than 7 cm. The insert of the golf club head may include a thermoplastic polymer or like materials. In preferred embodiments, the insert may include thermoplastic urethane (TPU).

In some embodiments, the at least one hollow rail may include a pair of opposing sidewalls extending from the sole and coupled to a base portion protruding a distance from the sole and including an exterior surface configured to directly contact ground when the club head is held at address and resting on the ground. The at least one hollow rail may taper in width from the sole towards the base portion. In one example, the pair of opposing sidewalls taper inwardly toward one another. In a preferred embodiment, the hollow rail has a trapezoidal profile. In other embodiments, each hollow rail may have a rectangular profile, a triangular circular profile, or any other like shape. In another preferred embodiment, the hollow rail has a multi-chine profile, in which the hollow rail provides multiple edges or "chines" that direct friction to a much smaller point of contact than a more rounded or flat profile. A hollow rail with a multi-chine profile further minimizes friction of the hollow rail in contact with ground or turf, thereby increasing club speed, and accordingly, increasing ball speed upon impact.

In some embodiments, the at least one hollow rail and the sole may include the same material. For example, the at least one hollow rail and the sole may both be made of steel, titanium, aluminum, tungsten or any other suitable metal or alloy materials. In certain embodiments, the at least one hollow rail and the sole may be integrally formed with one another and be of unitary construction. For example, the at least one hollow rail may be pressed or formed from a single piece of metal or alloy at the same time as the sole, thereby providing at least one hollow rail integrally formed with and of unitary construction with the sole.

In some embodiments, the insert is provided in a first portion of the hollow rail that is closer to a forward portion of the sole proximal to the ball striking face than an aft portion of the sole distal to the ball striking face. By providing the insert in the first portion, a mass distribution of the club head may be adjusted. For example, a hollow rail may be fully hollow or be partially filled with a material less dense than that of the insert, and the insert may be disposed at a forward portion of the sole such that the heavier insert is proximal to the ball striking face. Various mass distributions may be selected and adjusted via the insert and hollow rails to facilitate a stabilized turf interaction. In certain embodiments, the hollow rail further includes a second portion that is closer to the aft portion of the sole than the forward portion of the sole, in which the second portion is devoid of the insert.

The insert may form at least a portion of at least one of the pair of sidewalls of the at least one hollow rail. In some embodiments, the insert may form the entire sidewall, either entire sidewall, or at least a part of one sidewall of at least one hollow rail. In some embodiments, the sidewall may include an opening through which at least a portion of the insert is visible from an exterior of the golf club head. The insert may alternatively be entirely enclosed within the hollow rail. By providing the insert visible from the exterior of the club head, a golf club including the disclosed club head may be readily identified as having certain characteristics, such as being of a certain category, type, or brand. Such visible identifying characteristics may be provided to inform a golfer's club choice during play or purchasing choice when selecting a club.

The golf club head may generally be embodied as a hollow, wood-type club head, such as a head for a driver, a fairway, hybrid or utility club. However, the at least one hollow rail may also be used on a non-hollow-bodied club head, such as an iron, wedge, or putter.

The disclosure further provides a golf club head with a channel defined along a length of the sole of the club head and that traverses at least one hollow rail also disposed on the sole of the club head body. By providing a channel as described, rigidity of the club head may be attenuated to allow greater flexibility or compressibility in the club head, in response to the force of impact with a golf ball. For example, stiffness of the club head provided by the at least one hollow rail may be reduced or distributed by the channel. Greater flexibility and compressibility in response to an impact may provide the club head with a lesser degree of deformation through contact with the golf ball, resulting in improved impact efficiency and energy transfer. The lesser degree of deformation upon impact may assist the golfer in reducing twisting of the club head upon contact with the golf ball, helping the golfer attain the distance and lie intended by reducing off-target shots. Such effect increases accuracy by facilitating a shot closer to that anticipated and executed as compared to a shot where the club head twists in an unintended and unpredictable manner.

In another aspect, the invention provides a golf club head with a body defining a crown, a sole, a toe, a heel, and a ball striking face. The golf club head also includes a hosel extending upwards from the heel side of the body when at address, at least one hollow rail disposed on the sole, and a channel defined along a length of the sole and traverses at least one hollow rail. In some embodiments, the channel extends along a length of the sole in a heel-toe direction. The channel may be defined along a forward portion of the sole proximal to ball striking face. In certain embodiments, the hollow rail extends along a length of the sole from a forward portion of the sole proximal to ball striking face to an aft portion of the sole distal to the ball striking face.

In one example, the golf club head includes at least two hollow rails. The at least two hollow rails may be substantially parallel to each other. The at least two hollow rails may be spaced apart by approximately 1 cm to 7 cm. In some embodiments, the golf club head may further include an insert provided within at least a portion of at least one of the hollow rails. The insert of the golf club head may include a thermoplastic polymer. In preferred embodiments, the insert may include thermoplastic urethane (TPU).

In some embodiments, each hollow rail may include a pair of opposing sidewalls extending from the sole and coupled to a base portion protruding a distance from the sole and including an exterior surface configured to directly contact ground when the club head is held at address and resting on the ground. Each hollow rail may taper in width from the sole towards the base portion. In one example, the pair of opposing sidewalls taper inwardly toward one another. In one embodiment, each hollow rail has a trapezoidal profile. In other embodiments, each hollow rail may have a rectangular profile, a circular profile, or any other like shape. In a preferred embodiment, the hollow rail has a multi-chine profile, in which the hollow rail provides multiple edges or "chines" that direct friction to a much smaller point of contact than a more rounded or flat profile. Hollow rail(s) with a multi-chine profile further minimize friction of the hollow rail(s) in contact with ground or turf, and increase speed.

In some embodiments, the at least two hollow rails and the sole may include the same material. For example, the hollow rails and the sole may both be made of steel, titanium, aluminum, tungsten or any other suitable metal or alloy materials. In certain embodiments, the at least two hollow rails and the sole may be integrally formed with one another and be of unitary construction. For example, the hollow rails may be pressed from a single piece of metal or alloy at the same time as the sole, thereby providing hollow rails integrally formed with one another and of unitary construction with the sole.

In another embodiment, in at least one of the two hollow rails, the insert is provided in a first portion of the hollow rail that is closer to a forward portion of the sole proximal to the ball striking face than an aft portion of the sole distal to the ball striking face. By providing the insert in the first portion, a mass distribution of the club head may be adjusted. For example, a hollow rail may be fully hollow or be partially filled with a material less dense than that of the insert, and the insert may be disposed at a forward portion of the sole such that the heavier insert is proximal to the ball striking face. Various mass distributions may be selected and adjusted via the insert to facilitate a stabilized turf interaction. In certain embodiments, the at least one hollow rail further includes a second portion that is closer to the aft portion of the sole than the forward portion of the sole, in which the second portion is devoid of the insert.

The insert may form at least a portion of at least one of the pair of sidewalls of the hollow rails. In one example, the insert may form the entire sidewall, either entire sidewalls, or at least a part of one sidewall of at least one hollow rail. In some embodiments, the sidewall may include an opening through which at least a portion of the insert is visible from an exterior of the golf club head. The insert may alternatively be entirely enclosed within at least one of the at least two hollow rails.

DETAILED DESCRIPTION

The invention relates to a golf club head with at least one hollow rail disposed on the sole of the club head body, and an insert provided within at least a portion of the hollow rail. The invention further relates to a golf club head with a channel defined along a length of the sole of the club head and that traverses the at least one hollow rail. In some embodiments, the golf club head includes a pair of hollow rails. The at least one hollow rail provides the club head with improved movement across or through turf or ground, caused by contact between the club head and the terrain and assists the club to resist twisting prior to or during impact with the golf ball. A detailed description of the present invention is disclosed herein. It should be understood that the embodiments described are exemplary and should not be interpreted as limiting the scope of the invention. The detailed description disclosed herein is merely intended to teach one skilled in the art how to make and/or use the invention.

Figure 1:
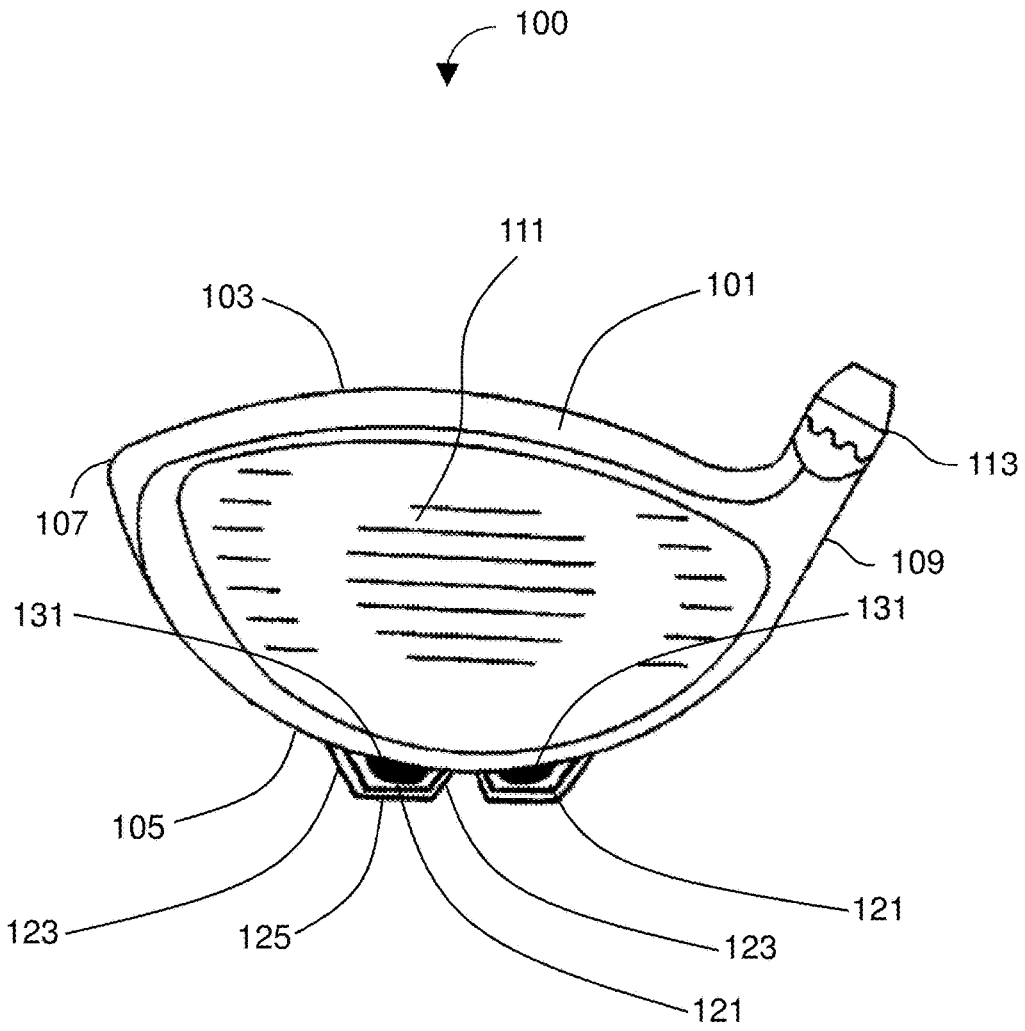
FIG. 1 shows a front view of the golf club head with hollow rails.

FIG. 1 shows a front view of the golf club head 100 with at least two hollow rails 121, each of which are shown in a cutaway view to illustrate an insert 131 within each, as described in greater detail herein. The club head 100 includes a body 101 defining a crown 103, a sole 105, a toe 107, a heel 109, and a ball striking face 111. The club head 100 also includes at least two hollow rails 121. As shown, the hollow rails 121 contain an insert 131 enclosed within each of the hollow rails 121. In other examples, the insert 131 may be only partially enclosed within at least one hollow rail 121, or an insert 131 may only be provided in at least one hollow rail 121. The hollow rails 121 provide club head 100 with a stabilized turf interaction that helps keep the club face straight and helps the player maintain accuracy. In contrast to solid metal rails, which slow down the club speed when playing on certain types of terrain, hollow rails 121 assist the player in maintaining club speed through the swing, such as when a shot is made in the rough. Improved club speed may provide a player with improved distance and a more favorable lie depending on the length to the hole and terrain presented in a shot.

In certain embodiments, each hollow rail 121 includes opposing sidewalls 123. The opposing sidewalls 123 may extend from the sole 105 and be coupled to a base portion 125 protruding a distance from the sole 105 and including an exterior surface configured to directly contact ground when the club head 100 is held at address and resting on the ground. In various embodiments, each hollow rail 121 may extend along a length of the sole 105 from a forward portion of the sole 105 proximal to the ball striking face 111 to an aft portion of the sole 105 distal to the ball striking face 111.

The club head 100 is configured to attach to a shaft via a hosel 113 that extends upwards from the heel side of the body 101 when the club is at address. Preferably, the golf club head 100 is a wood or hybrid-type club; however, the invention may be employed on other types of clubs, such as an iron. The club head 100 may be formed from any suitable material, including metals, such as titanium, steel, aluminum, other metal alloy materials, composite or other non-metal materials, polymeric materials, and combinations of various materials. The club head 100 may be formed from one material i.e., a single cast or forged piece of metal or composite, or a combination of materials. In certain embodiments, the hollow rails 121 and the sole 105 include or are made of the same material. The hollow rails 121 and the sole 105 may be integrally formed with one another and of unitary construction. For example, at least the sole 105 of the club head 101 and the hollow rails 121 may both be cast or forged from a piece of titanium such that the sole 105 and the hollow rails 121 are integrally formed and of unitary construction.

As shown, the hollow rails 121 are substantially parallel to each other. In other embodiments, the hollow rails 121 may not be substantially parallel to each other. For example, the hollow rails 121 may be curved or inclined inward toward each other, away from each other, or in varying directions. Further, as shown, each of the hollow rails 121 tapers in width from the sole towards the base portion. In certain embodiments, the pair of opposing sidewalls 123 taper inwardly toward one another. In one example, each hollow rail 121 has a uniform profile, such as a trapezoidal profile, a rectangular profile, a triangular profile, a circular profile, or any other like shape. In a preferred embodiment, the hollow rails have a multi-chine profile, in which each hollow rail provides multiple edges or "chines" that direct friction to a much smaller point of contact than a more rounded or flat profile. Hollow rails with a multi-chine profile further minimize friction of the hollow rail in contact with ground or turf, thereby increasing club speed, and accordingly, increasing ball speed upon impact.

The hollow rails 121 may be spaced apart by approximately 1 cm to 7 cm.

The hollow rails 121 are at least partially hollow and may include or be partially filled with any suitable materials, such as metals, alloys, polymers, plastics, composites or other fillers. Thus, at least the composition, position, and orientation of each of the hollow rails 121 and insert 131 may be varied to optimize the turf interaction of the club head 100, among many features. For example, the insert 131 may include a thermoplastic polymer and may be positioned to adjust a mass distribution of the club head 100.

In some embodiments, in the at least one of the two hollow rails 121, the insert 131 is provided in a first portion of the hollow rail that is closer to a forward portion of the sole 105 proximal to the ball striking face 111 than an aft portion of the sole 105 distal to the ball striking face 111. In one example, at least one hollow rail 121 may further include a second portion that is closer to the aft portion of the sole 105 than the forward portion of the sole 105, in which the second portion is devoid of the insert 131. By positioning the insert 131 in the first portion of the hollow rail 121 proximal to the ball striking face 111, as compared to a second portion distal to the ball striking face 111 that is devoid of the insert 131, a center of gravity of the club head 100 may be adjusted in a forward direction. In this example, adjusting the center of gravity may assist the club head 100 in providing a stabilized turf interaction by resisting twisting of the club head 100 prior to impact with a golf ball, as the club head 100 is swung through the rough.

In various embodiments, insert 131 may include a thermoplastic polymer. In preferred embodiments, insert 131 may include thermoplastic urethane (TPU). The insert 131 may disposed in at least one of the at least two hollow rails 121. As shown, insert 131 is entirely enclosed within at least one of the pair of hollow rails 121. In some embodiments, insert 131 forms at least a portion of at least one of the pair of sidewalls 123. In other embodiments, insert 131 may form an entire sidewall of at least one of the pair of sidewalls 123. In one example, at least one of the pair of sidewalls 123 may include an opening through which at least a portion of the insert 131 is visible from an exterior of the golf club head 100. By providing the insert 131 visibly from the exterior of the club head 100, a golf club including club head 100 may be readily identified as having certain characteristics, such as being of a certain category, type, or brand. Such visible identifying characteristics may be provided to inform a golfer's club choice during play or purchasing choice when selecting a club.

Figure 2:
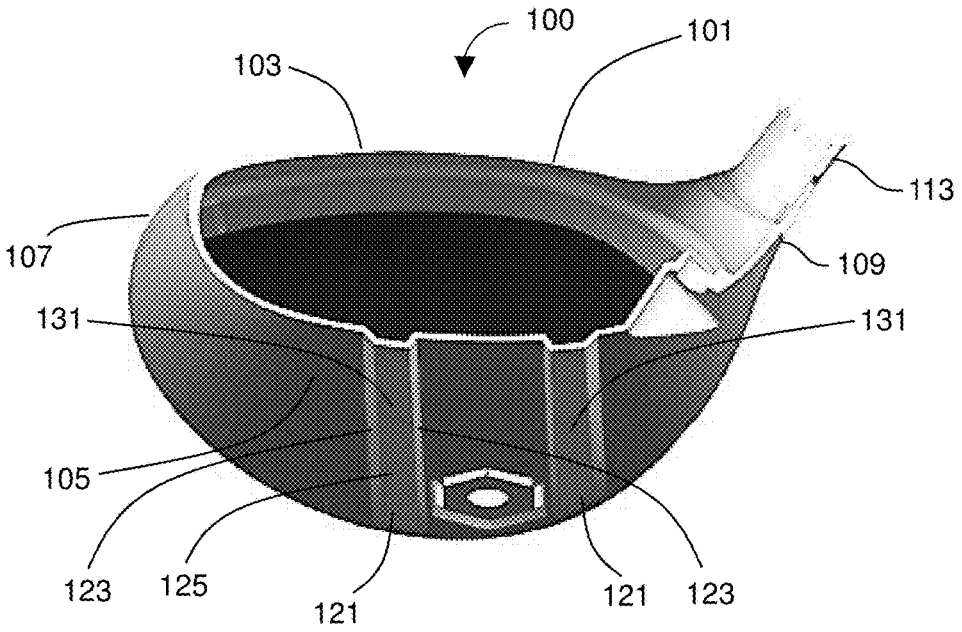
FIG. 2 shows a front view cross section of the golf club head with hollow rails.

FIG. 2 shows a front view of the golf club head 100 with at least two hollow rails 121. In this embodiment, each of the at least two hollow rails 121 includes opposing sidewalls 123, which extend from the sole 105 and are coupled to a base portion 125 protruding a distance from the sole 105 and including an exterior surface configured to directly contact ground when the club head 100 is held at address and resting on the ground. The club head 100 may benefit from reduced friction upon contact with turf or the ground due at least in part to the hollow rails 121 protruding from sole 105.

In this embodiment, the hollow rails 121 are substantially parallel to each other and taper in width from the sole 105 towards the base portion 125. In particular, the pair of opposing sidewalls 123 taper inwardly toward one another, and each hollow rail 121 has a trapezoidal profile.

Figure 3:
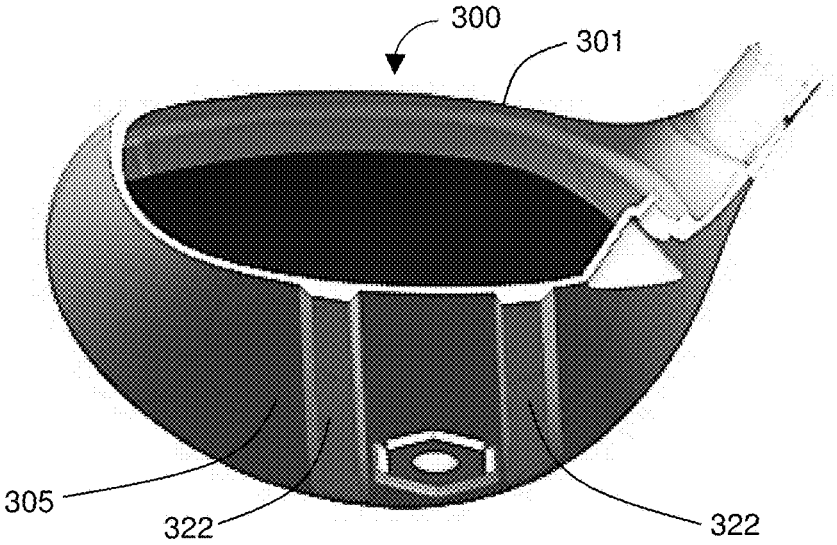
FIG. 3 shows a front view cross section of a golf club head with solid rails.

FIG. 3 shows a front view cross section of a golf club head 300 with solid rails 322, in contrast to the hollow rails described above. Club head 300 has a body 301 with a sole 305 and solid rails 322 disposed on the sole 305. Solid rails 322 add significant mass to club head 300 and accordingly slow down the club speed of club head 300. In addition, club head 300 lacks discretionary mass as compared to club head 100 that may be advantageously positioned throughout other parts of club head 100 to provide structural support, an optimized mass distribution, and other important features, among many.

Figure 4:
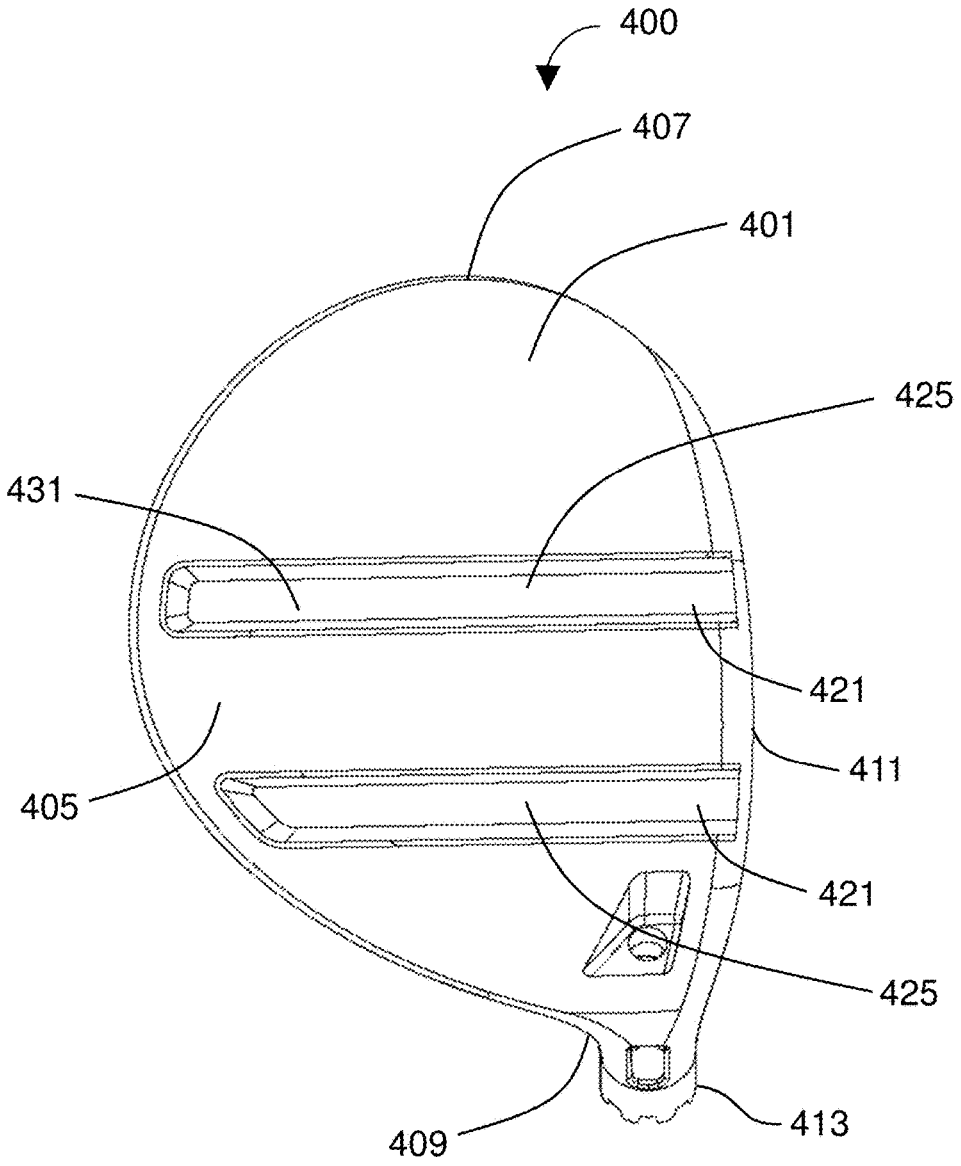
FIG. 4 shows a bottom view of the golf club head with the insert enclosed within the hollow rails.

FIG. 4 shows a bottom view of the golf club head 400 with an insert 431 enclosed within one of the two hollow rails 421. The club head 400 includes a body 401 defining a crown (not shown), a sole 405, a toe 407, a heel 409, and a ball striking face 411. The club head 400 also includes two hollow rails 421 and a hosel 413 that extends upwards from the heel side of the body 401 when the club is at address. As shown, one of the hollow rails 421 contains an insert 431 enclosed within the hollow rail 421. In this example, each hollow rail 421 includes opposing sidewalls 423 that extend from the sole 405 and are coupled to a base portion 425 protruding a distance from the sole 405. Base portion 425 may provide the club head 400 with reduced friction upon contact with turf, helping reduce twisting forces upon the club head 400 prior to impact with a golf ball.

In this example, each hollow rail 421 extends along a length of the sole 405 from a forward portion of the sole 405 proximal to the ball striking face 411 to an aft portion of the sole 405 distal to the ball striking face 411. As shown, the hollow rails 421 are substantially parallel to each other and have a rectangular profile. In addition, hollow rails 421 and sole 405 are integrally formed with one another and are of unitary construction, meaning hollow rails 421 and sole 405 may be constructed, stamped, or formed of a single piece of metal, alloy, or other suitable material. In this example, hollow rails 421 are spaced approximately 2-3 cm apart from each other. In other examples, hollow rails 421 may be spaced approximately 1-7 cm apart from each other or greater than 7 cm apart from each other.

Figure 5:
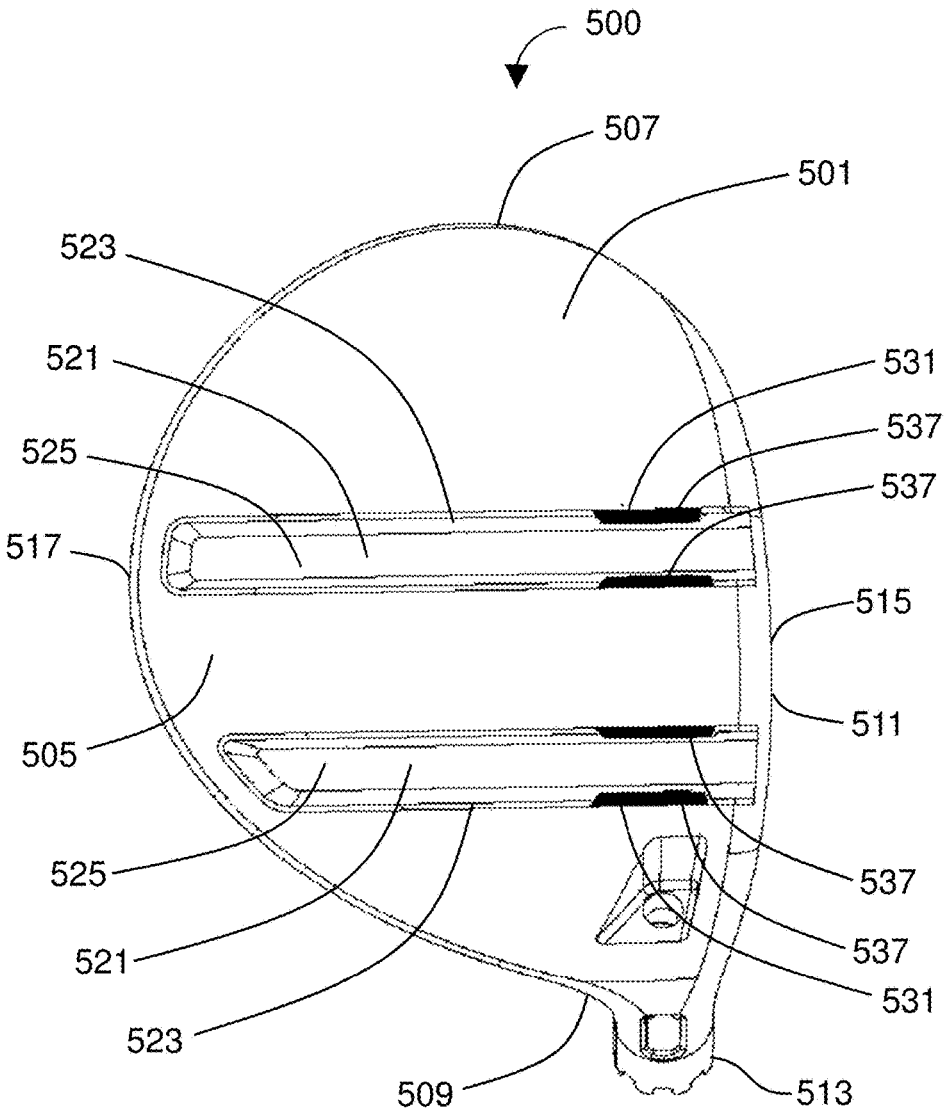
FIG. 5 shows a bottom view of the golf club head with the insert visible.

FIG. 5 shows a bottom view of the golf club head 500 with each insert 531 visible from the exterior of the golf club head 500, through openings 537. In various embodiments, insert 531 may vary in color, texture, material, or other characteristics from the hollow rails 521 and/or from the sole 505. Thus, golf club head 500 may be uniquely identified as having certain characteristics, such as loft angle, shot attribute, or hollow rail height extending from the sole 405 based at least in part on the portion of the insert 531 visible at openings 537.

The club head 500 includes a body 501 defining a crown (not shown), a sole 505, a toe 507, a heel 509, and a ball striking face 511. The club head 500 also includes at least two hollow rails 521 and a hosel 513. In this example, each of the hollow rails 521 contains an insert 535, and each insert 535 forms at least a portion of at least one of the pair of opposing sidewalls 523 of hollow rails 521. In other examples, the insert 535 may form at least one entire sidewall 523 or both entire sidewalls 523 of a hollow rail 521.

The opposing sidewalls 523 extend from the sole and are coupled to a base portion 525 protruding a distance from the sole 505 and including an exterior surface configured to directly contact ground when the club head 500 is held at address and resting on the ground. In various embodiments, each hollow rail 521 may extend along a length of the sole 505 from a forward portion 515 of the sole 503 proximal to the ball striking face 511 to an aft portion 517 of the sole 505 distal to the ball striking face 511. As shown, the hollow rails 521 are substantially parallel to each other. In other embodiments, the hollow rails 521 may not be substantially parallel to each other. For example, the hollow rails 521 may be curved or inclined inward toward each other, away from each other, or in varying directions.

Figure 6:
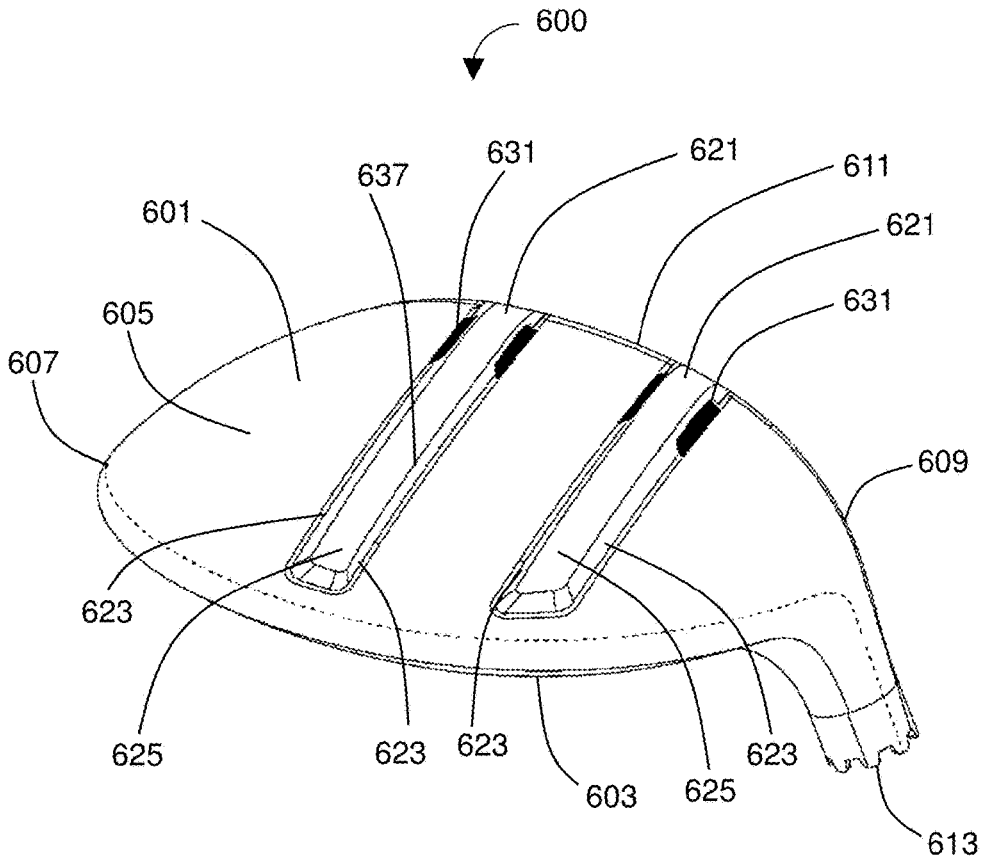
FIG. 6 shows a bottom perspective view of the golf club head with the insert visible.

FIG. 6 shows a bottom perspective view of the golf club head 600 with each insert 631 visible from the exterior of each of the hollow rails 621. Although illustrated with each insert 631 visible from the exterior of the hollow rails 621, in other embodiments, neither or only at least a part of the at least one insert 631 may be visible from the exterior of the hollow rails 621.

The club head 600 includes a body 601 defining a crown 603, a sole 605, a toe 607, a heel 609, and a ball striking face 611. The club head 600 also includes at least two hollow rails 621 and a hosel 613. As shown, the hollow rails 621 contain an insert 631 disposed within each of the hollow rails 621. In this example, each hollow rail 621 includes opposing sidewalls 623. The opposing sidewalls 623 extend from the sole and are coupled to a base portion 625 protruding a distance from the sole 605 and including an exterior surface configured to directly contact ground when the club head 600 is held at address and resting on the ground. In various embodiments, each hollow rail 621 may extend along a length of the sole 605 from a forward portion of the sole 605 proximal to the ball striking face 611 to an aft portion of the sole 605 distal to the ball striking face 611. As shown, the hollow rails 621 are substantially parallel to each other and are spaced apart a length between 1-7 cm from each other.

Figure 7A:
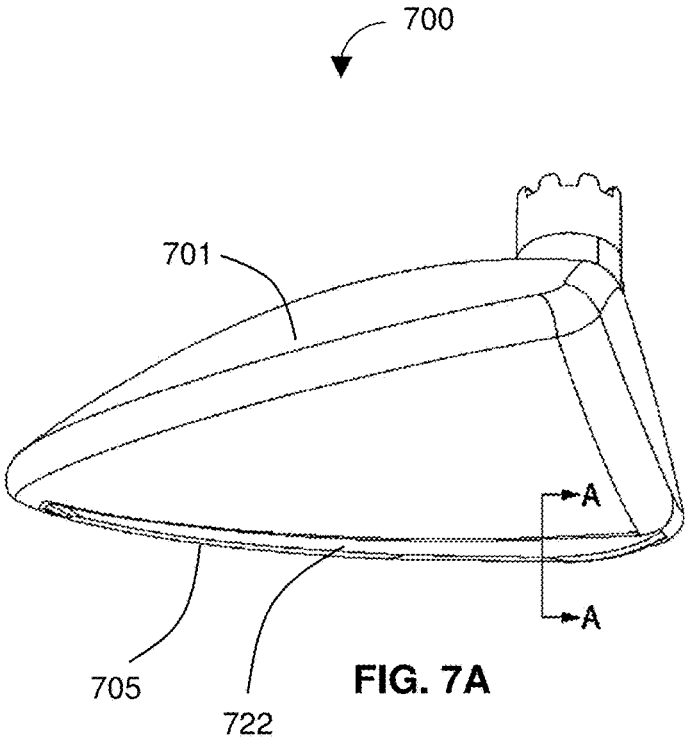
FIG. 7A shows a front view of a golf club head with solid rails.

FIG. 7A shows a front view of a golf club head 700 with solid rails 722. In this illustration of a club head 700 with solid rails 722, the club head 700 includes a body 701 that includes a sole 705. The club head 700 includes solid rails 722 protruding from the sole 705 of the club. The solid rails 722 may be made of a metal to provide durability through each shot. However, by providing solid rails 722, the club head 700 suffers from an increased amount of mass that is a part of its construction. As such, any additional structural, aesthetic, or electronic features, among others, will only add further mass to the club head 700. The additional mass included in the club head 700 by the solid rails slows down the club speed of club head 700. Decreased club speed reduces distance achieved in even a well-aimed shot, which is not preferable for many golfers.

Cross section A of solid rail 722 is shown intersecting the solid rail 722, and is described below.

Figure 7B:
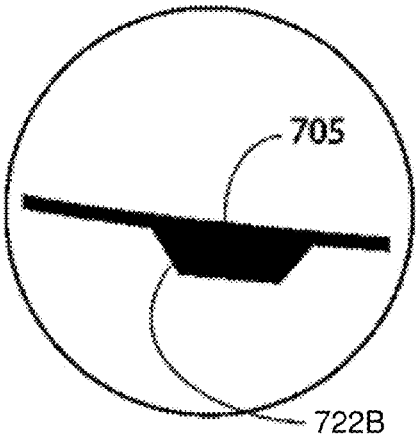
FIGS. 7B and 7C show enlarged cross sections of the golf club head of FIG. 7A taken along lines A-A illustrating different embodiments of a rail on the sole, including a solid rail (FIG. 7B) and a hollow rail (FIG. 7C).

FIG. 7B shows an enlarged cross section of a golf club head 700 with solid rail 722B, which protrudes outwardly from the sole 705.

Figure 7C:
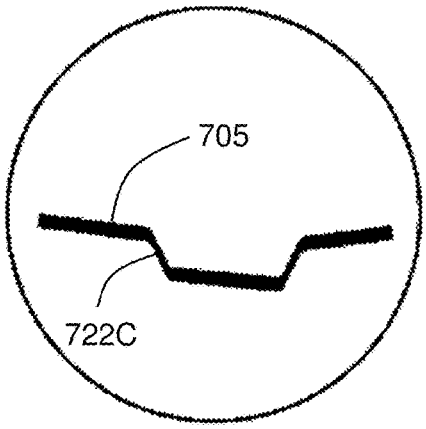

In contrast to FIG. 7B, FIG. 7C illustrates a hollow rail of the invention. In this enlarged cross section, hollow rail 722C protrudes outwardly from the sole 705.

Figure 8A:
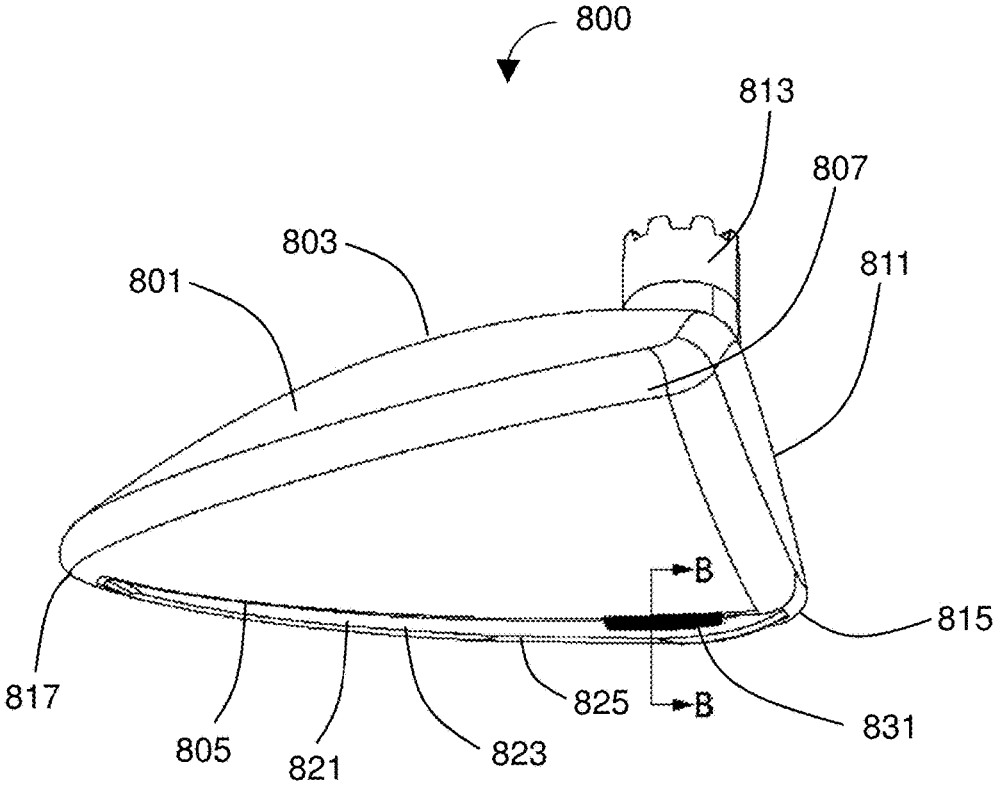
FIG. 8A shows a front view of the golf club head with an insert.

FIG. 8A shows a front view of the golf club head 800 with the insert 831 enclosed within the hollow rails 821. In contrast to the solid rails 722A of club head 700, the hollow rails 821 provide the club head 800 with less fixed mass and instead free up discretionary mass to allow a golfer or club designer to advantageously tailor various aspects of the club head 800 to player characteristics, such as a particular swing. For example, the club head 800 may use the discretionary mass to add a support member, such as a support rib or struts may be provided to further increase the rigidity of the club head structure.

In this embodiment, golf club head 800 includes a body 801 defining a crown 803, a sole 805, a toe 807, a heel (not shown), and a ball striking face 811. The club head 500 also includes at least one hollow rail 821 and a hosel 813. In this example, hollow rail 821 extends along a length of the sole 805 from a forward portion 815 of the sole 805 proximal to the ball striking face 811 to an aft portion 817 of the sole 805 distal to the ball striking face 811. As shown, hollow rail 821 contains an insert 831 that is enclosed within the sidewalls 823 and base portion 825 of the hollow rails 821.

Cross section B of hollow rail 821 is shown intersecting the hollow rail 821 and insert 831, enclosed within the hollow rail 821.

Figure 8B:
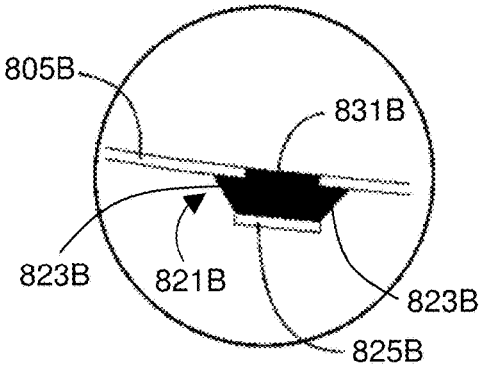
FIGS. 8B, 8C, and 8D show enlarged cross sections of the golf club head of FIG. 8A taken along lines B-B illustrating different embodiments of an insert associated with one or more rails on the club head.

FIG. 8B shows an enlarged cross section of the golf club head 800, according to one embodiment, with the insert 831B enclosed within the hollow rail 821B, from the cross section identified at B, above.

In this example, hollow rail 821B protrudes from the sole 805B and includes a pair of sidewalls 823B and a base portion 825B protruding a distance from the sole 805B and including an exterior surface configured to directly contact ground when the club head 800 is held at address and resting on the ground. Insert 831B is enclosed within the hollow rail 821B and makes up both sidewalls 823B and a portion of sole 805B.

Figure 8C:
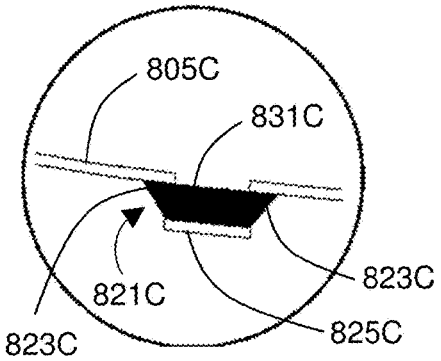

FIG. 8C shows an enlarged cross section of the golf club head 800, according to another embodiment, with the insert 831C enclosed within the hollow rail 821C, from the cross section identified at B, above.

In this example, hollow rail 821C protrudes from the sole 805C and includes a pair of sidewalls 823C and a base portion 825C protruding a distance from the sole 805C and including an exterior surface configured to directly contact ground when the club head 800 is held at address and resting on the ground. Insert 831C is enclosed within the hollow rail 821C and makes up both sidewalls 823C. In contrast to the hollow rail 821B shown in FIG. 8B, insert 831C does not make up a portion of sole 805C.

Figure 8D:
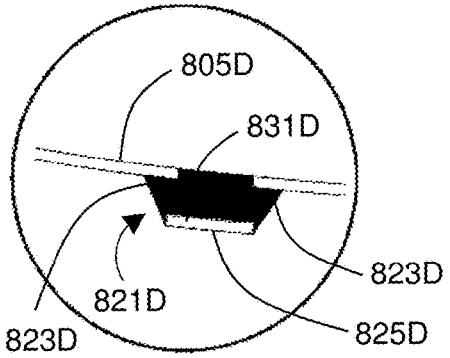

FIG. 8D shows an enlarged cross section of the golf club head 800, according to another embodiment, with the insert 831D enclosed within the hollow rail 821D, from the cross section identified at B, above.

In this example, hollow rail 821D protrudes from the sole 805D and includes a pair of sidewalls 823D and a base portion 825D protruding a distance from the sole 805D and including an exterior surface configured to directly contact ground when the club head 800 is held at address and resting on the ground. As shown, insert 831D is enclosed within the hollow rail 821D, makes up both sidewalls 823D, and extends along each sidewall 823D, forming at least a part of base portion 825D. In contrast to the hollow rail 821C shown in FIG. 8C, insert 831D does make up a portion of sole 805D.

Figure 9A:
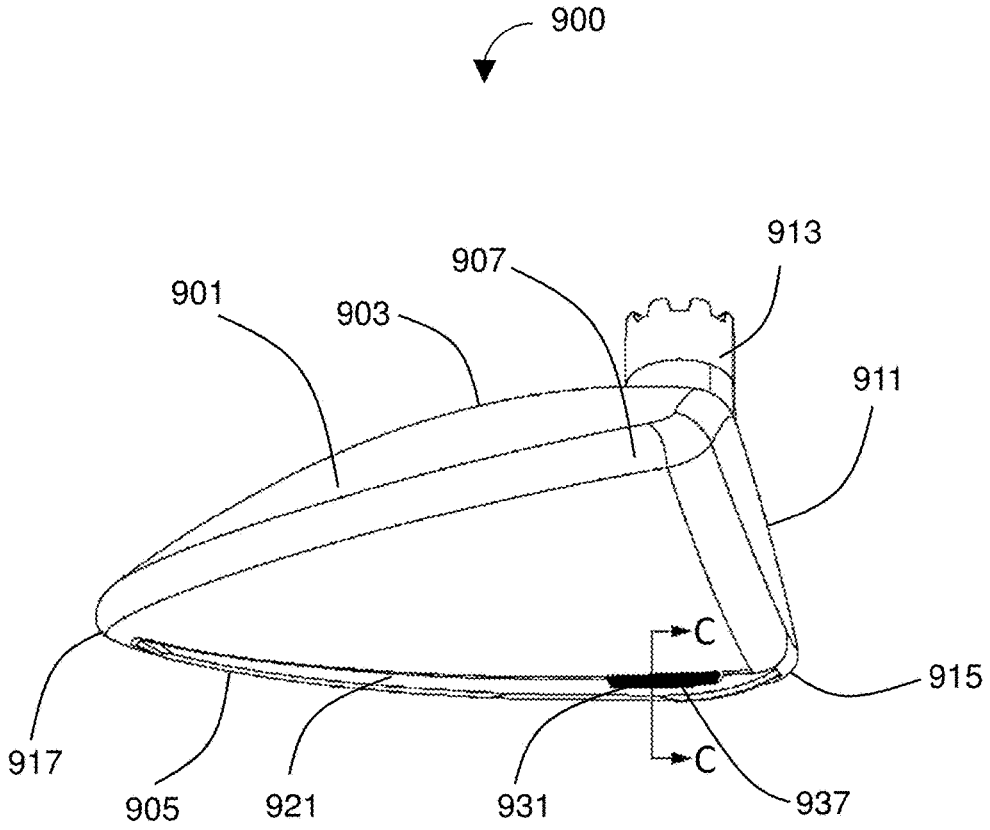
FIG. 9A shows a front view of the golf club head with an insert.

FIG. 9A shows a front view of the golf club head 900 with the insert 931 making up at least one entire sidewall 923 of the hollow rails 921. Also, insert 931 is visible from the exterior of the golf club 900 through opening 937. As such, club head 900 may be uniquely identified or characterized at least in part by the portion of insert 931 visible at opening 937.

In this embodiment, golf club head 900 includes a body 901 defining a crown 903, a sole 905, a toe 907, a heel (not shown), and a ball striking face 911. The club head 900 also includes at least two hollow rails 921 and a hosel 913. In this example, each of the hollow rails 921 extends along a length of the sole 905 from a forward portion 915 of the sole 905 proximal to the ball striking face 911 to an aft portion 917 of the sole 905 distal to the ball striking face 911. As shown, each of the hollow rails 921 contains an insert 931, and each insert 931 makes up an entire sidewall 923 of the hollow rails 921.

Cross section C of hollow rail 921 is shown intersecting the hollow rail 921 and insert 931, which is enclosed within the hollow rail 921.

Figure 9B:
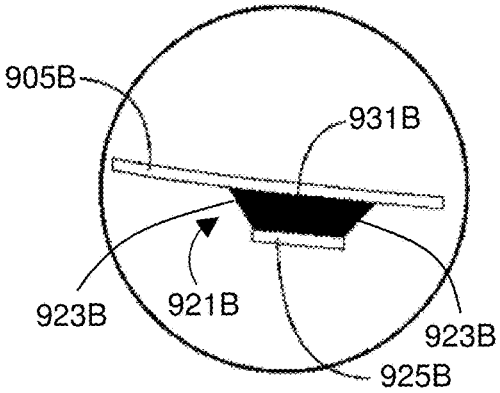
FIGS. 9B, 9C, 9D, and 9E show enlarged cross sections of the golf club head of FIG. 9A taken along lines C-C illustrating different embodiments of a rail on the sole and an insert associated with the rail, including an insert that makes up a portion of both sidewalls of a hollow rail (FIG. 9B), an insert that makes up a portion of one sidewall of a hollow rail (FIG. 9C), an insert that makes up a portion of one sidewall of a hollow rail and a portion of the sole (FIG. 9D), and an insert that makes up a portion of one sidewall of a hollow rail and a portion of the sole (FIG. 9E).

FIG. 9B shows an enlarged cross section of the golf club head 900, according to one embodiment, with the insert 931B making up the entirety of both sidewalls 923B of the hollow rail 921B, from the cross section identified at C, above. In this example, hollow rail 921B protrudes from the sole 905B and includes a pair of sidewalls 923B and a base portion 925B.

Although illustrated with insert 931B making up the entirety of both sidewalls 923B, in other embodiments, insert 931 may make up one entire sidewall 923, at least part of one sidewall 923, or at least part of both sidewalls 923.

Figure 9C:
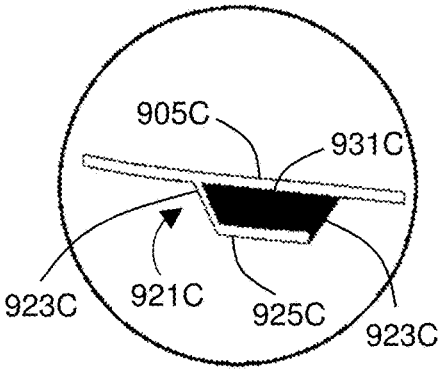

FIG. 9C shows an enlarged cross section of the golf club head 900, according to another embodiment, with the insert 931C making up the entirety of one sidewall 923C of the hollow rail 921C, from the cross section identified at C, above. In this example, hollow rail 921C protrudes from the sole 905C and includes a pair of sidewalls 923C and a base portion 925C. As shown, insert 931C makes up the entirety of one sidewall 923C and extends along that sidewall, forming at least a part of base portion 925C.

Figure 9D:
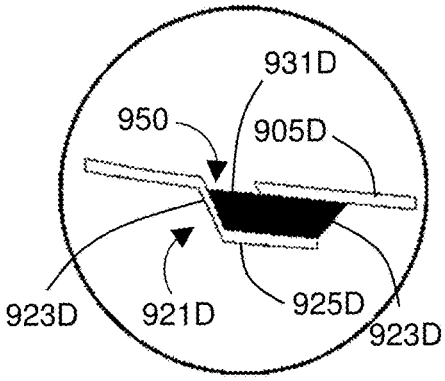

FIG. 9D shows an enlarged cross section of the golf club head 900, according to another embodiment, with the insert 931D making up the entirety of one sidewall 923D of the hollow rail 921D, from the cross section identified at C, above. In this example, hollow rail 921D protrudes from the sole 905D and includes a pair of sidewalls 923D and a base portion 925D. As shown, insert 931D makes up the entirety of one sidewall 923D, but does not extend along that sidewall or form at least a part of base portion 925D, in contrast to the insert 931C in FIG. 9C. In addition, sole 905D includes an opening 950, through which the insert 931D may be accessed.

Figure 9E:
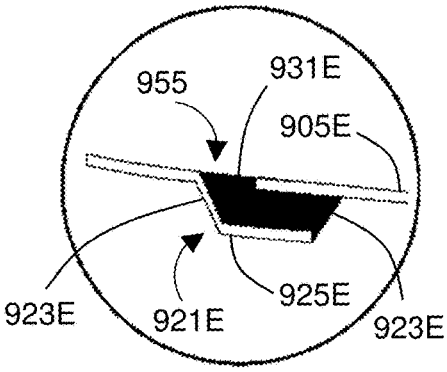

FIG. 9E shows an enlarged cross section of the golf club head 900, according to another embodiment, with the insert 931E making up the entirety of one sidewall 923E of the hollow rail 921E, from the cross section identified at C, above. In this example, hollow rail 921E protrudes from the sole 905E and includes a pair of sidewalls 923E and a base portion 925E. As shown, insert 931E makes up the entirety of one sidewall 923E, and also extends along that sidewall, forming at least a part of base portion 925E. In addition, sole 905E includes an opening 955, through which the insert 931E may be accessed. In this embodiment, insert 931E extends at least partially through opening 955 and forms at least a part of the sole 905E at opening 955.

Figure 10A:
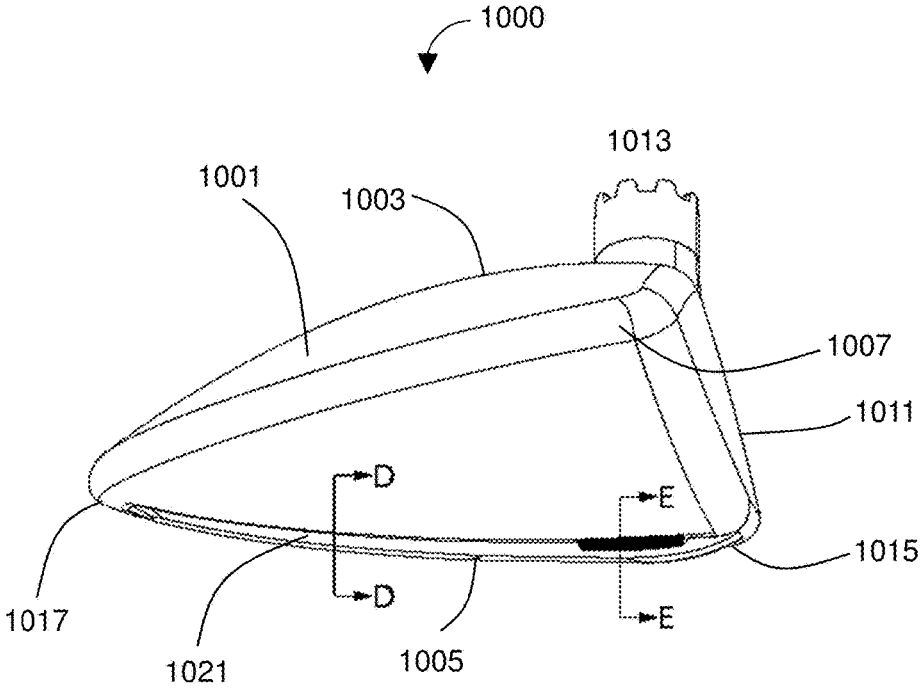
FIG. 10A shows a front view of the golf club head with an insert.

FIG. 10A shows a front view of the golf club head 1000 with the insert 1031 making up a portion of both of the sidewalls 1023 of the hollow rails 1021.

In this embodiment, golf club head 1000 includes a body 1001 defining a crown 1003, a sole 1005, a toe 1007, a heel (not shown), and a ball striking face 1011. The club head 1000 also includes at least two hollow rails 1021 and a hosel 1013. In this example, each of the hollow rails 1021 extends along a length of the sole 1005 from a forward portion 1015 of the sole 1005 proximal to the ball striking face 1011 to an aft portion 1017 of the sole 1005 distal to the ball striking face 1011. As shown, each of the hollow rails 1021 contains an insert 1031. In various embodiments, each insert 1031 may be fully enclosed within the sidewalls 1023 or may make up a portion or the entirety of one or both of the sidewalls 1023 of the hollow rails 1021.

Cross section D of hollow rail 1021 is shown intersecting a portion of hollow rail 1021 that is filled with a metal. Cross section E of hollow rail 1021 is shown intersecting a portion of hollow rail 1021 that includes insert 1031.

Figure 10B:
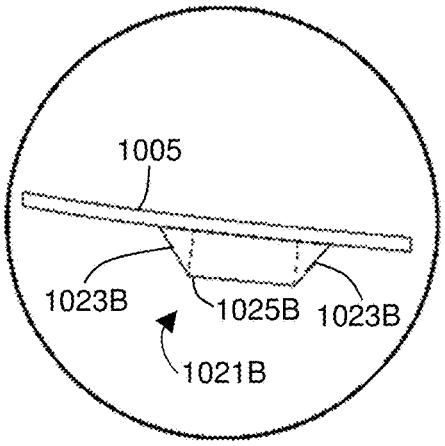
FIG. 10B shows an enlarged cross section of the golf club head of FIG. 10A taken along lines D-D illustrating a solid portion of a hollow rail of the golf club head.

FIG. 10B shows an enlarged cross section of a portion of the hollow rail 1021, from the cross section identified at D, above. The hollow rails 1021 are at least partially hollow. In this example, hollow rail 1021B protrudes from the sole 1005 and includes a pair of sidewalls 1023B and a base portion 1025B. At cross section D, the hollow rail 1021B may be at least partially filled with a metal, alloy, composite, or other suitable materials.

Figure 10C:
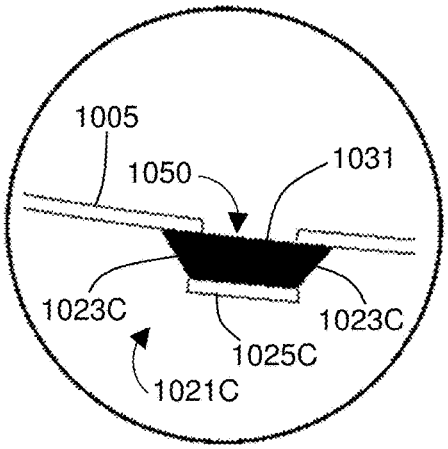
FIG. 10C shows an enlarged cross section of the golf club head of FIG. 10A taken along lines E-E illustrating a portion of the hollow rail with the insert making up a portion of the sidewalls of the hollow rail.

FIG. 10C shows an enlarged cross section of a portion of the hollow rails 1021 containing insert 1031, from the cross section identified at E, above. As shown, insert 1031 makes up at least a portion of each of the sidewalls 1023C of the hollow rails 1021C. In this example, insert 1031 is made of TPU and is connected to base portion 1025C of hollow rail 1021C. In addition. insert 1031 is connected to sole 1005, but does not extend through opening 1050 of the sole 1005. In other embodiments, insert 1031 may extend at least partially through an opening in the sole 1005, such as that shown at opening 1050 or at other positions along sole 1050.

Figure 11:
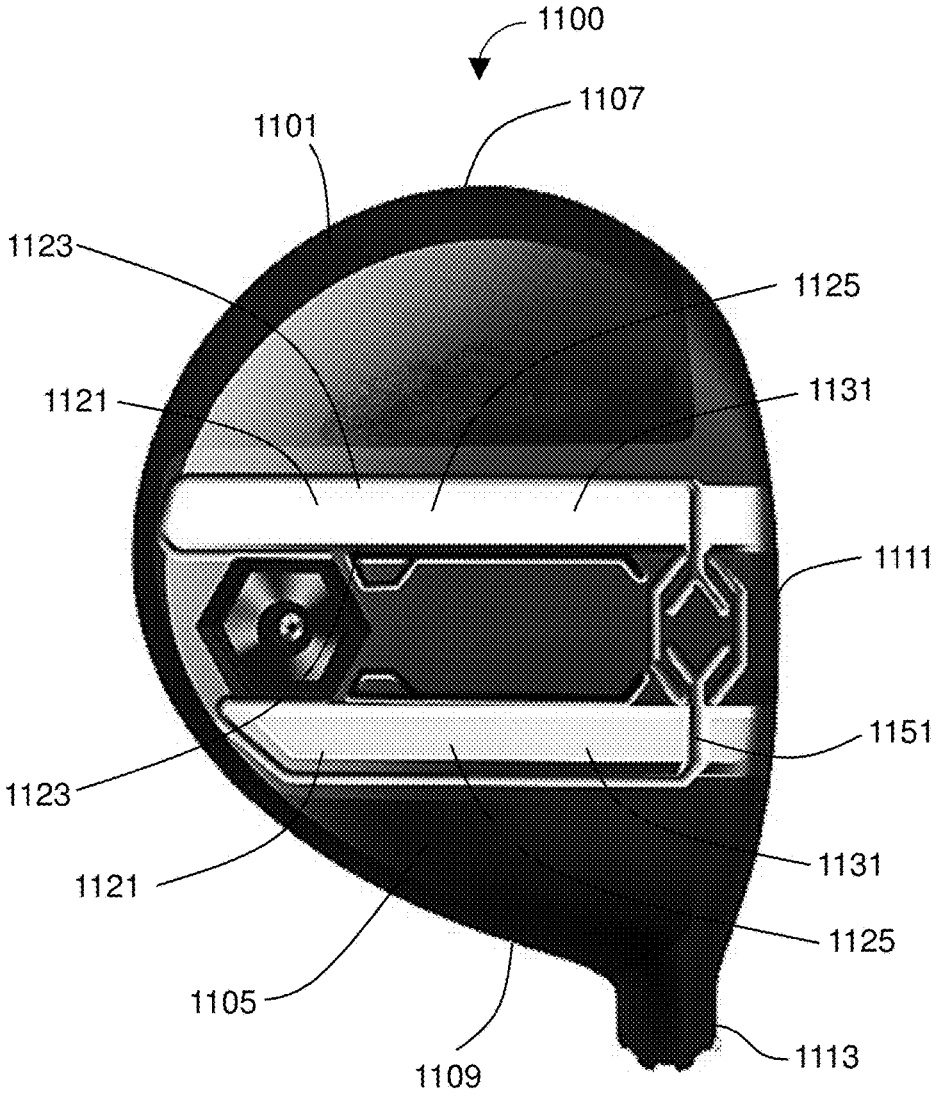
FIG. 11 shows a bottom view of the golf club head illustrating the sole including a channel traversing a pair of hollow rails defined thereon.

FIG. 11 shows a bottom view of the golf club head 1100 with at least two hollow rails 1121 and a channel 1151 that traverses the at least two hollow rails 1121. Channel 1151 may attenuate stiffness or rigidity of the club head 1100 and provide the club head 1100 with greater flexibility or compressibility, in response to the force of impact with a golf ball. For example, stiffness of the club head 1100 provided by the hollow rails 1121 may be reduced or distributed by the channel 1151.

By providing club head 1100 with greater flexibility and compressibility in response to an impact, club head 1100 may benefit from a lesser degree of deformation through contact with a golf ball, resulting in improved impact efficiency and energy transfer. The lesser degree of deformation upon impact may assist the golfer in reducing twisting of the club head 1100 upon contact with the golf ball, helping the golfer attain the distance and lie intended by reducing off-target shots. Such effect increases accuracy by facilitating a shot closer to that anticipated and executed as compared to a shot where a club head twists in an unintended and unpredictable manner.

The club head 1100 includes a body 1101 defining a crown (not shown), a sole 1105, a toe 1107, a heel 1109, and a ball striking face 1111. The club head 1100 also includes at least two hollow rails 1121. As shown, each hollow rail 1121 includes an insert 1131 enclosed within each of the hollow rails 1121. In this example, each hollow rail 1121 includes opposing sidewalls 1123. The opposing sidewalls 1123 extend from the sole 1105 and are coupled to a base portion 1125 protruding a distance from the sole 1105 and including an exterior surface configured to directly contact ground when the club head 1100 is held at address and resting on the ground. In other examples, club head 1100 may not include an insert 1131 in both or either of the hollow rails 1121.

In various embodiments, each hollow rail 1121 may extend along a length of the sole 1103 from a forward portion of the sole 1103 proximal to the ball striking face 1111 to an aft portion of the sole 1103 distal to the ball striking face 1111. As shown, the hollow rails 1121 are substantially parallel to each other. In other embodiments, the hollow rails 1121 may not be substantially parallel to each other. For example, the hollow rails 1121 may be curved or inclined inward toward each other, away from each other, or in varying directions.

The club head 1100 is configured to attach to a shaft via a hosel 1113 that extends upwards from the heel side of the body 1101 when the club is at address. Preferably, the golf club head 1100 is a wood or hybrid-type club; however, the invention may be employed on other types of clubs, such as an iron. The club head 1100 may be formed from any suitable material, including metals, such as titanium, steel, aluminum, other metal alloy materials, composite or other non-metal materials, polymeric materials, and combinations of various materials. The club head 100 may be formed from one material i.e., a single cast or forged piece of metal or composite, or a combination of materials. In certain embodiments, the hollow rails 1121 and the sole 1105 include or are made of the same material. The two hollow rails 1121 and the sole 1105 may be integrally formed with one another and of unitary construction. For example, at least the sole 1105 of the club head 1100 and the hollow rails 1121 may both be cast or forged from a piece of titanium such that the sole 1105 and the hollow rails 1121 are integrally formed and of unitary construction.

As shown, each of the hollow rails 1121 tapers in width from the sole towards the base portion. In certain embodiments, the pair of opposing sidewalls 1123 taper inwardly toward one another. In one example, each hollow rail 1121 has a uniform profile, such as a trapezoidal profile, a rectangular profile, a triangular profile, a circular profile, or any other like shape. The hollow rails 1121 may be spaced apart by approximately 1 cm to 7 cm.

By providing insert 1131 in at least one of the hollow rails, a mass distribution of the club head may be adjusted. For example, the use of a low-density thermoplastic material in the insert 1131 allows discretionary mass to be "freed up" and such mass may be advantageously distributed throughout other parts of the club head 1100. Similarly, by providing the club head 1100 with hollow rails 1121 having less mass as compared to solid rails, discretionary mass saved may be advantageously distributed throughout other parts of the club head. The discretionary mass may be positioned elsewhere in the club head 1100 to optimize mass distribution or perform structural functions of the club head 1100. For example, the center of gravity or mass distribution of club head 1100 may be customized based on the composition, relative arrangement, size, dimension, and material of the insert 1131 as well as the hollow rails 1121. In various embodiments, insert 1131 may include a thermoplastic polymer. In preferred embodiments, insert 1131 may include thermoplastic urethane (TPU).

Adjusting the center of gravity or mass distribution may allow the club head 1100 to exhibit a high rotational moment of inertia about a vertical axis, reducing the likelihood of twisting upon contact with the terrain or ground. In addition, the discretionary mass may be provided as a support member such as a support rib or struts may be provided to further increase the rigidity of the club head structure. The insert 1131 may also be designed to modify the vibrating frequency, resonance, volume, or timbre of sound resulting from impact between the club head 1100 and a golf ball. For example, the insert 1131 may be designed such that a consistent sound is received upon accurate contact.

The insert 1131 may disposed in at least one of the at least two hollow rails 1121. As shown, insert 1131 is entirely enclosed within at least one of the pair of hollow rails 1121. In some embodiments, insert 1131 forms at least a portion of at least one of the pair of sidewalls 1123. In other embodiments, insert 1131 may form an entire sidewall of at least one of the pair of sidewalls 1123. For example, at least one of the pair of sidewalls 1123 may include an opening through which at least a portion of the insert 1131 is visible from an exterior of the golf club head 1100. By providing the insert 1131 visibly from the exterior of the club head 1100, a golf club including club head 1100 may be readily identified as having certain characteristics, such as being of a certain category, type, or brand.

In various embodiments, in the at least one of the two hollow rails 1121, the insert 1131 is provided in a first portion of the hollow rail that is closer to a forward portion of the sole 1105 proximal to the ball striking face 1111 than an aft portion of the sole 1105 distal to the ball striking face 1111. In one example, at least one hollow rail 1121 may further include a second portion that is closer to the aft portion of the sole 103 than the forward portion of the sole 1105, in which the second portion is devoid of the insert 1131.

Figure 12A:
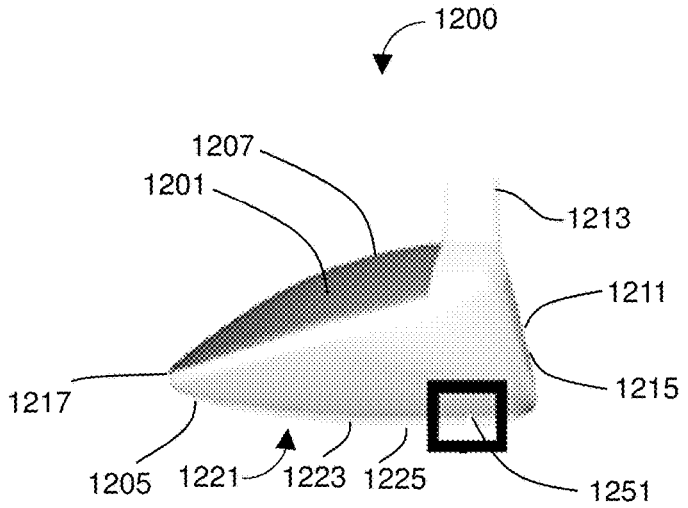
FIG. 12A shows a toe-facing view of the golf club head illustrating the sole including a channel and hollow rails defined thereon.

FIG. 12A shows a front view of the golf club head 1200 with at least two hollow rails 1221 and a channel 1251 that traverses the at least two hollow rails 1221, disposed on the sole 1205. Channel 1251 provides the club head 1200 with greater flexibility than a club head lacking channel 1251. In particular, when club head 1200 contacts a golf ball, the channel 1251 may provide club head 1200 with a lesser degree of deformation through impact with the golf ball, resulting in improved impact efficiency and energy transfer to the golf ball. The lesser degree of deformation may also reduce twisting of the club head 1200 prior to contact with the golf ball, helping the golfer reduce off-target shots and improve distance and accuracy in their shots from the rough, among the many terrain lies presented during play. The hollow rails 1221 provide a stabilized turf interaction that helps shots that are hit from the rough to fly straight. The channel 1251 may attenuate rigidity or stiffness in the club head 1200 caused by the hollow rails 1221 or other components. By providing channel 1251, club head 1200 benefits from the stabilized turf interaction of the hollow rails 1221 as well as a greater degree of flexibility in the sole 1205.

The club head 1200 includes a body 1201 defining a crown 1203, a sole 1205, a toe 1207, a heel (not shown), and a ball striking face 1211. The club head 1200 also includes at least two hollow rails 1221 disposed on the sole 1205, and a hosel 1213 extending upwards from the heel side of the body 1201 when at address. In this example, a TPU insert 1231 is disposed within the hollow rail 1221 shown in the front view. The hollow rail 1221 includes opposing sidewalls 1223, which extend from the sole 1205 and are coupled to a base portion 1225 protruding a distance from the sole 1205. The base portion 1225 includes an exterior surface configured to directly contact ground when the club head 1200 is held at address and resting on the ground.

In various embodiments, the channel 1251 extends along a length of the sole 1205 in a heel-toe direction. The channel 1251 may be defined along a forward portion 1215 of the sole 1205 proximal to ball striking face 1211. In this example, the hollow rail 1221 extends along a length of the sole 1205 from a forward portion 1215 of the sole 1205 proximal to the ball striking face 1211 to an aft portion 1217 of the sole 1205 distal to the ball striking face 1211. As shown, the channel 1251 traverses the at least two hollow rails 1221 at approximately a perpendicular angle. In other embodiments, channel 1251 may traverse the at least two hollow rails 1221 at an angle that is not perpendicular. Alternatively, channel 1251 may traverse at least one of the at least two hollow rails 1221 at an angle that differs from that at which it traverses other hollow rails 1221. The channel 1251 may also extend to other portions of the club head 1200 in addition to traversing the at least two hollow rails 1221. For example, the channel 1251 may extend past, after traversing, a hollow rail 1221 and may extend to other parts of the sole 1205.

The square shown near the sole 1205 indicates a viewing frame of an enlarged portion of the channel 1251.

Figure 12B:
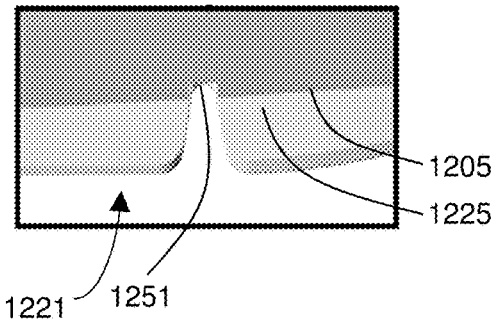
FIG. 12B shows an enlarged view of a portion of the sole of the golf club head of FIG. 12A illustrating the channel in greater detail.

FIG. 12B shows an enlarged portion of the front view of the golf club head 1200 with a channel 1251 traversing the hollow rails 1221, as identified by the square described above. As shown, hollow rail 1221 protrudes from the sole 1205 and is traversed by a channel 1251 defined along a length of the sole 1205. In this example, channel 1251 traverses hollow rail 1221 at approximately a perpendicular angle.

Figure 12C:
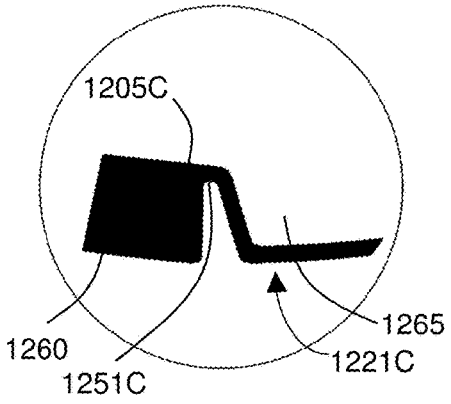
FIG. 12C shows an enlarged side cross section of the channel and hollow rails.

FIG. 12C shows a side cross section view of the golf club head 1200 with a channel 1251C traversing the hollow rails 1221C. As shown, left portion 1260 of hollow rail 1221C is solid and may be filled with a metal, an alloy, or other suitable materials. In contrast, right portion 1265 of hollow rail 1221C is hollow. In this embodiment, left portion 1260 and right portion 1265 of hollow rail 1221C are split by channel 1251C, which traverses the hollow rails 1221C.

Figure 13:
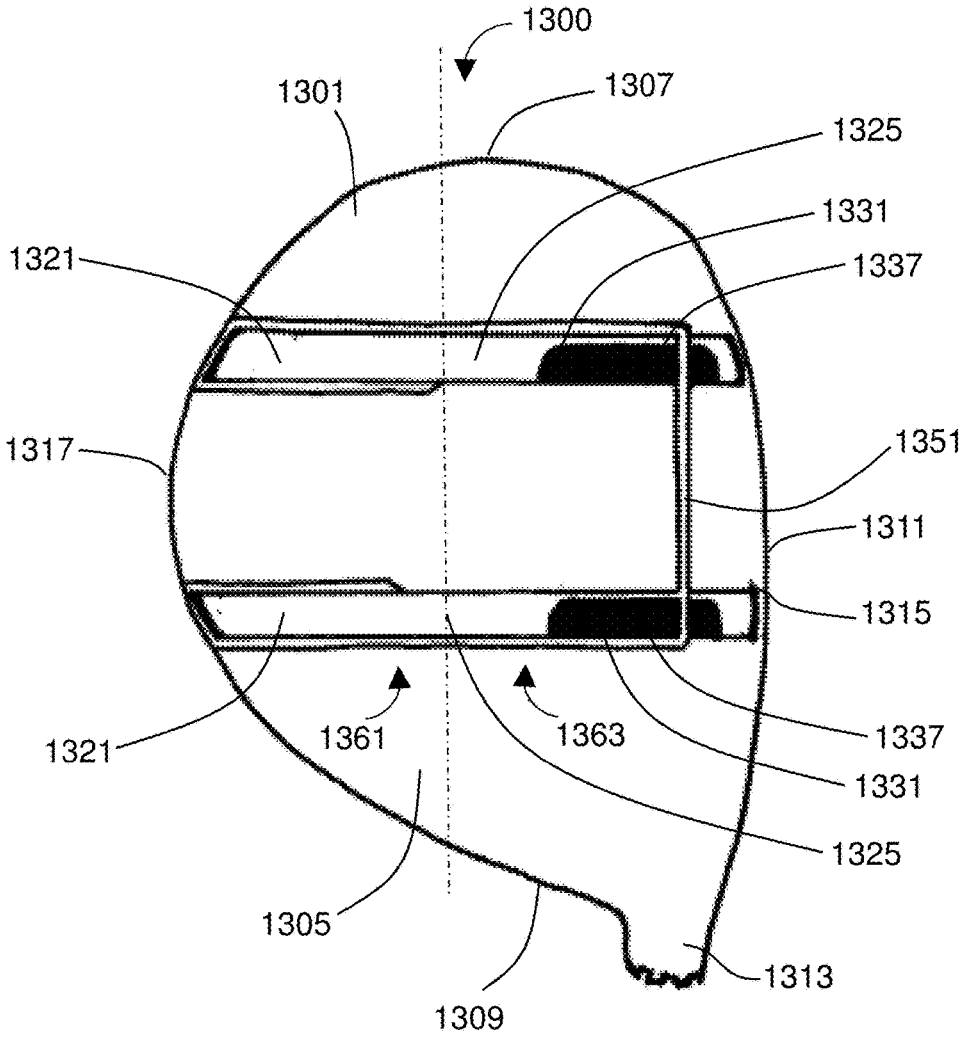
FIG. 13 shows a bottom view of a golf club head illustrating a sole with a channel, hollow rails, and a visible insert.

FIG. 13 shows a bottom view of the golf club head 1300 with at least two hollow rails 1321, a channel 1351 traversing the at least two hollow rails 1321, and an insert 1331 disposed within each of the hollow rails 1321. As shown, the insert 1331 is visible from the exterior of the golf club head 1300 through openings 1337.

The club head 1300 includes a body 1301 defining a crown (not shown), a sole 1305, a toe 1307, a heel 1309, and a ball striking face 1311. The club head 1300 also includes at least two hollow rails 1331 that are substantially parallel to each other, and channel 1351 traversing the hollow rails 1321. In this embodiment, channel 1351 traverses the at least two hollow rails 1321 at approximately a perpendicular angle, although such angle may vary in relation to one, both, or any hollow rails 1321 disposed on the sole 1305.

In certain embodiments, the club head 1300 may include an insert 1331 disposed within at least a portion of at least one of the at least two hollow rails 1321. For example, the insert 1331 may be provided in a first portion 1363 of hollow rail 1321 that is closer to a forward portion 1315 of the sole 1305 proximal to the ball striking face 1311 than an aft portion 1317 of the sole 1305 distal to the ball striking face 1311. The first portion 1363 may be of any length or portion of the hollow rail 1321.

In this example, the first portion 1363, is indicated as to the right of a dotted line (provided for reference) and proximal to the ball striking face 1311, as compared to a second portion 1361 devoid of the insert 1331. The second portion 1361 is indicated as to the left of the dotted line and distal to the ball striking face 1311. The second portion 1361 may be at least partially filled with a metal, an alloy, or other suitable materials, but devoid of the insert 1331. The second portion 1361 may be of any length or portion of the hollow rail 1321, as long as it is distal to ball striking face 1311, as compared to first portion 1363.

In other examples, first portion 1361 may include the insert 1331 and be distal to the ball striking face 1311; whereas second portion 1361 may be devoid of the insert 1331 and be proximal to the ball striking face 1311 as compared to first portion 1361.

Club head 1300 benefits from the stabilized turf interaction provided by the hollow rails 1321, greater flexibility provided by channel 1351, and a customizable mass distribution provided by the insert 1331. Because insert 1331 is visible from the exterior of the hollow rails 1321, a golf club including club head 1300 may be readily identified or distinguished based on the insert 1331. For example, insert 1331 may be a different color, texture, or material than sole 1305 and/or hollow rails 1321. Accordingly, a golfer may make a purchasing decision or a club selection decision during play based at least in part on characteristics of the insert 1331 visible through opening 1337.

Figure 14:
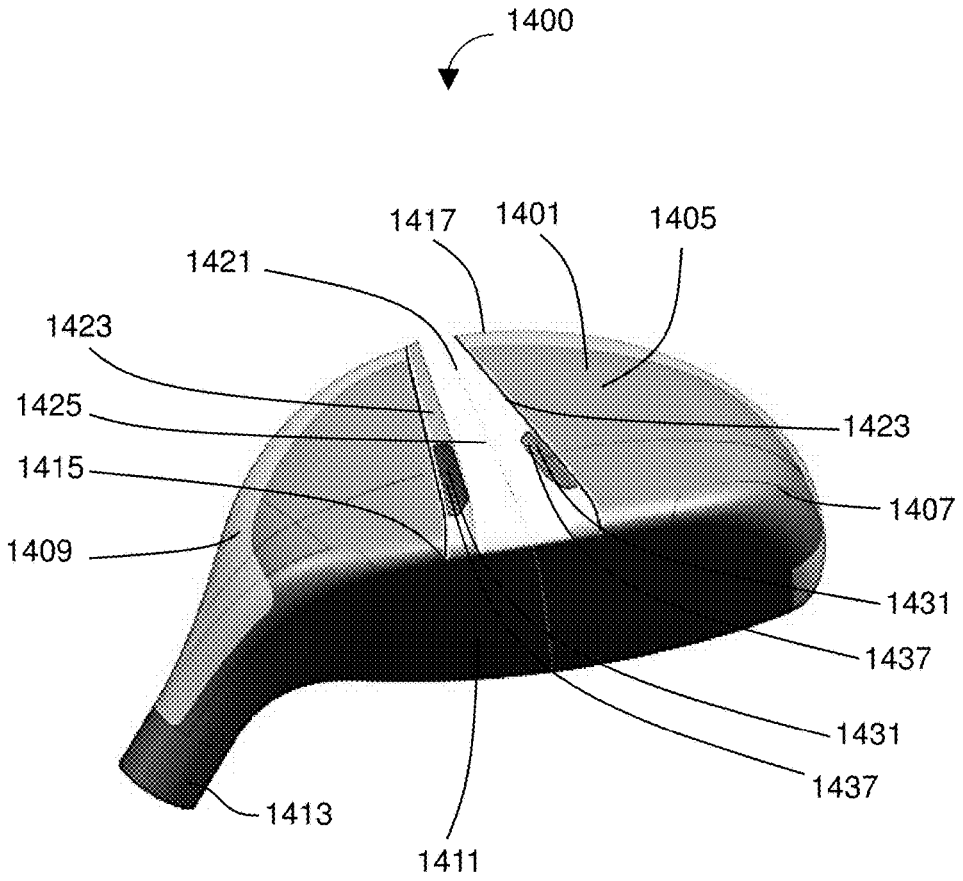
FIGS. 14 and 15 show perspective views of a golf club head illustrating a sole of the club head including an insert enclosed within one hollow rail, wherein a portion of the insert is visible from the exterior of the golf club head.

FIG. 14 shows a bottom perspective view of the golf club head 1400 with the insert 1431 enclosed within one hollow rail 1421. In this embodiment, the insert 1431 is visible from the exterior of the hollow rail 1421. Specifically, the insert 1431 makes up at least a portion of each of a pair of opposing sidewalls 1423 of the hollow rail 1421, and is visible from openings 1437 at each of the sidewalls 1423. In various embodiments, insert 1431 may include a thermoplastic polymer. In preferred embodiments, insert 1431 may include thermoplastic urethane (TPU). As shown, the opposing sidewalls 1423 may extend from the sole 1405 and be coupled to a base portion 1425 protruding a distance from the sole 1405 and including an exterior surface configured to directly contact ground when the club head 1400 is held at address and resting on the ground. A golf club including club head 1400 may be readily identified or distinguished based on the insert 1431. For example, insert 1431 may be a different color, texture, or material than sole 1405 and/or hollow rail 1421. Accordingly, a golfer may make a purchasing decision or a club selection decision during play based at least in part on characteristics of the insert 1431 visible through opening 1437.

The club head 1400 includes a body 1401 defining a crown (not shown), a sole 1405, a toe 1407, a heel 1409, and a ball striking face 1411. The club head 1400 also includes at least one hollow rail 1421 disposed on the sole 1405. Although in other embodiments, the club head 1400 may have at least two or more than two hollow rails 1421, in this illustration, the club head 1400 includes one hollow rail 1421. In various embodiments, the hollow rail 1421 may extend along a length of the sole 1405 from a forward portion 1415 of the sole 1405 proximal to the ball striking face 1411 to an aft portion 1417 of the sole 1405 distal to the ball striking face 1411.

In various embodiments, the hollow rail 1421 may be substantially straight or may be curved or inclined in various directions, such as toward a portion of the club head 1400 or sole 1405. Further, as shown, the hollow rail 1421 tapers in width from the sole towards the base portion 1425. In certain embodiments, the pair of opposing sidewalls 1423 taper inwardly toward one another. In one example, the hollow rail 1421 has a uniform profile, such as a trapezoidal profile, a rectangular profile, a circular profile, or any other like shape. Although shown with the insert 1431 making up a portion of both sidewalls 1423 and visible at two openings 1437, in other embodiments, insert 1431 may make up only a portion of one sidewall 1423, may be completely enclosed within both sidewalls 1423, or may be visible from only one opening 1437 on either sidewall 1423 or base portion 1425.

The hollow rail 1421 provides club head 1400 with a stabilized turf interaction that helps keep the club face straight and helps the player maintain accuracy. In contrast to a solid metal rail, which slows down the club speed when playing on certain types of terrain, the hollow rail 1421 assists the player in maintaining or improving club speed through the swing, such as when a shot is made in the rough. Improved club speed may provide a player with improved ball speed and accordingly, improved distance achieved by a shot.

The club head 1400 is configured to attach to a shaft via a hosel 1413 that extends upwards from the heel side of the body 101 when the club is at address. Preferably, the golf club head 1400 is a wood or hybrid-type club; however, the invention may be employed on other types of clubs, such as an iron. The club head 1400 may be formed from any suitable material, including metals, such as titanium, steel, aluminum, other metal alloy materials, composite or other non-metal materials, polymeric materials, and combinations of various materials. The club head 1400 may be formed from one material i.e., a single cast or forged piece of metal or composite, or a combination of materials. In certain embodiments, the hollow rails 1421 and the sole 1405 include or are made of the same material. The hollow rails 1421 and the sole 1405 may be integrally formed with one another and of unitary construction. For example, at least the sole 1405 of the club head 1401 and the hollow rails 1421 may both be cast or forged from a piece of titanium such that the sole 1405 and the hollow rails 1421 are integrally formed and of unitary construction.

The hollow rail 1421 is at least partially hollow and may include or be partially filled with any suitable materials, such as metals, alloys, polymers, plastics, composites or other fillers. Thus, at least the composition, position, and orientation of the hollow rail 1421 and insert 1431 may be varied to optimize the turf interaction of the club head 1400, among many features. For example, the insert 1431 may include a thermoplastic polymer and may be positioned to adjust a mass distribution of the club head 1400. The insert 1431 may be designed and positioned to improve the ball speed produced by the club head 1400 due to the improved turf interaction.

In some embodiments, the insert 1431 is provided in a first portion of the hollow rail 1421 that is closer to a forward portion 1415 of the sole 105 proximal to the ball striking face 1411 than an aft portion 1417 of the sole 1405 distal to the ball striking face 1411. In one example, the hollow rail 1421 may further include a second portion that is closer to the aft portion 1417 of the sole 1405 than the forward portion 1415 of the sole 1405, in which the second portion is devoid of the insert 1431. By positioning the insert 1431 in the first portion of the hollow rail 1421 proximal to the ball striking face 1411, as compared to a second portion distal to the ball striking face 1411 that is devoid of the insert 1431, a center of gravity of the club head 1400 may be adjusted in a forward direction. In this example, adjusting the center of gravity may assist the club head 1400 in providing a stabilized turf interaction and improving ball speed by resisting twisting of the club head 1400 prior to impact with a golf ball, as the club head 1400 is swung through the rough.

Although not illustrated showing a channel, the club head 1400 may further include a channel defined along a length of the sole 1405 of the club head 1400 and that traverses the at least one hollow rail 1421 also disposed on the sole 1405 of the club head body 1401. In various embodiments, the channel may extend along a length of the sole 1405 in a heel-toe direction and be defined along a forward portion 1415 of the sole 1405 proximal to ball striking face 1411. By providing a channel as described, rigidity of the club head may be attenuated to allow greater flexibility or compressibility in the club head, in response to the force of impact with a golf ball. Greater flexibility and compressibility in response to an impact may provide the club head with a lesser degree of deformation through contact with the golf ball, resulting in improved impact efficiency and energy transfer. The lesser degree of deformation upon impact may assist the golfer in reducing twisting of the club head upon contact with the golf ball, helping the golfer attain the distance and lie intended by reducing off-target shots. Such effect increases accuracy by facilitating a shot closer to that anticipated and executed as compared to a shot where the club head twists in an unintended and unpredictable manner.

Figure 15:
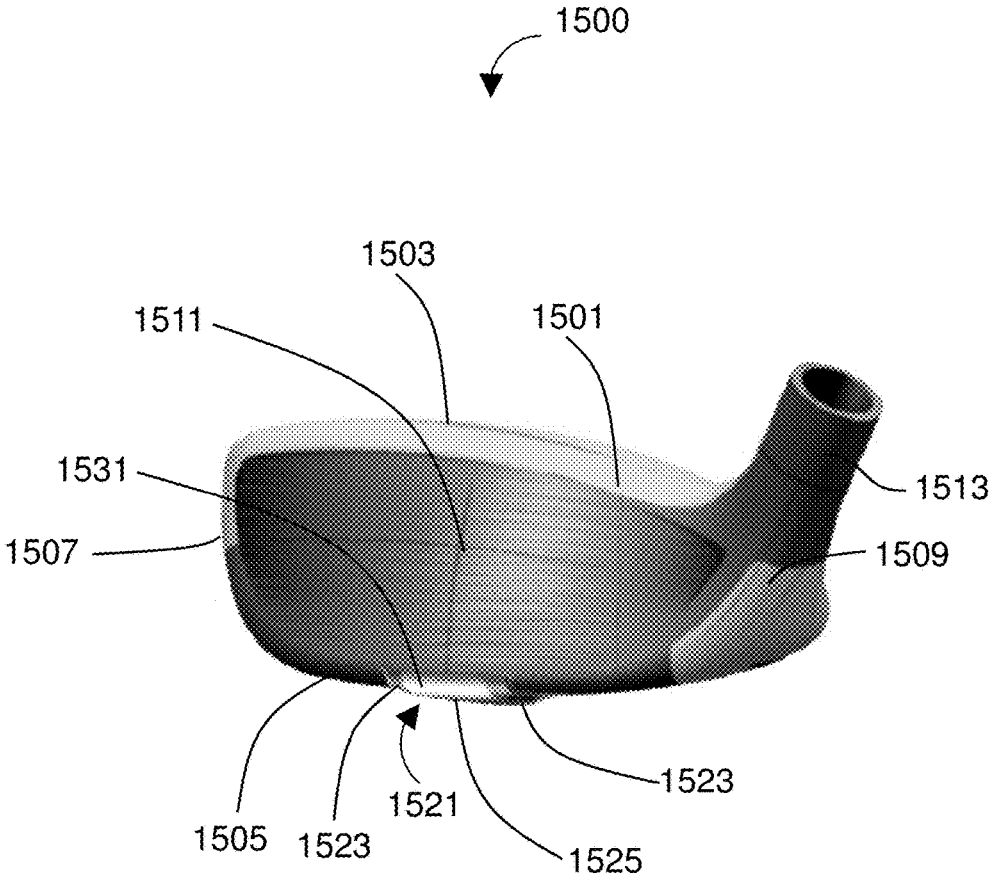

FIG. 15 shows a side perspective view of the golf club head 1500 with the insert 1531 enclosed within one hollow rail 1521. The club head 1500 includes a body 1501 defining a crown 1503, a sole 1505, a toe 1507, a heel 1509, and a ball striking face 1511. The club head 1500 is configured to attach to a shaft via a hosel 1513 that extends upwards from the heel side of the body 1501 when the club is at address. The club head 1500 also includes at least one hollow rail 1521 disposed on the sole 1505. Although in other embodiments, the club head 1500 may have at least two or more than two hollow rails 1521, in this illustration, the club head 1500 includes one hollow rail 1521.

In various embodiments, the hollow rail 1521 may extend along a length of the sole 1505 from a forward portion of the sole 1505 proximal to the ball striking face 1511 to an aft portion of the sole 1505 distal to the ball striking face 1511. As shown, the hollow rail 1521 includes opposing sidewalls 1523, which may extend from the sole 1505 and be coupled to a base portion 1525 protruding a distance from the sole 1505 and including an exterior surface configured to directly contact ground when the club head 1500 is held at address and resting on the ground.

In this embodiment, the insert 1531 not visible from the exterior of the hollow rail 1521 and does not form a portion of either sidewall 1523. Specifically, insert 1531 is fully enclosed within sidewalls 1523. In various embodiments, insert 1531 may include a thermoplastic polymer. In preferred embodiments, insert 1531 may include thermoplastic urethane (TPU). By providing club head 1500 with at least one hollow rail 1521 on its sole 1505, a golfer making a shot with club head 1500 may benefit from improved ball speed due to the improved interaction between the club head 1500 and turf or ground.

Figure 16:
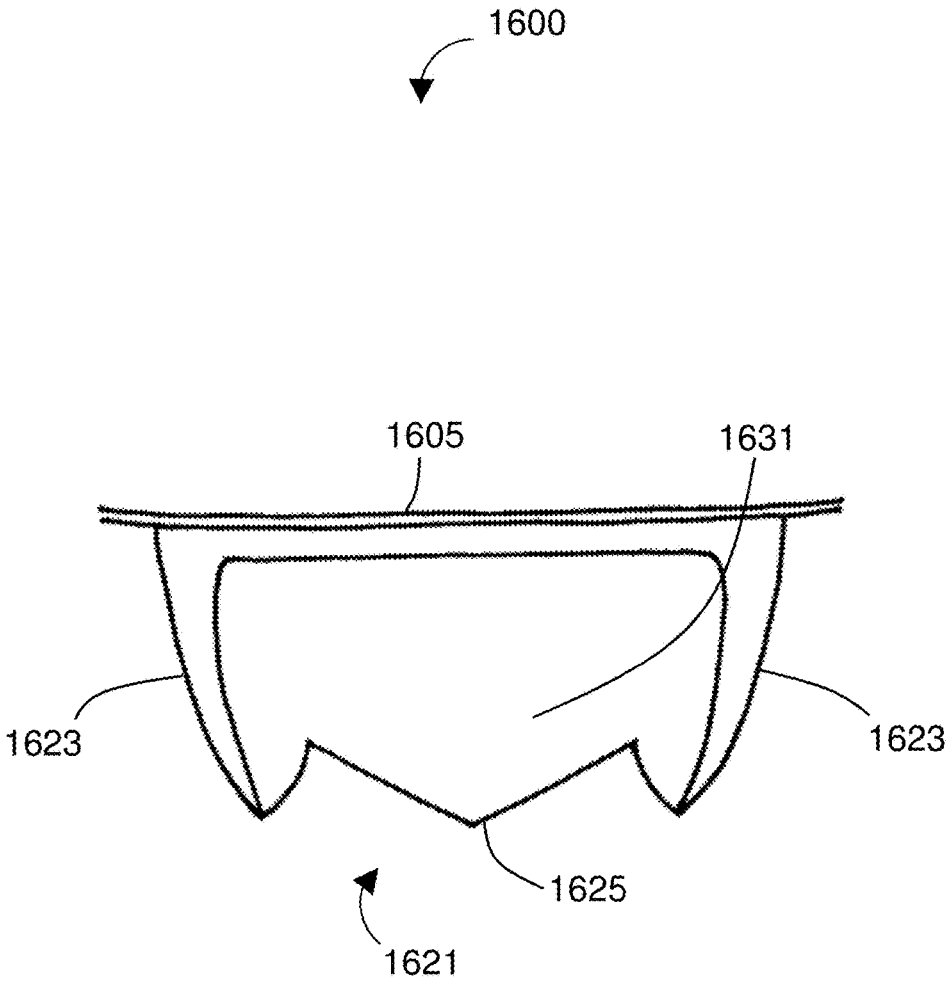
FIG. 16 shows an enlarged front view of a hollow rail with a multi-chine profile.

FIG. 16 shows an enlarged front view of a hollow rail 1621 with a multi-chine profile 1600. In the multi-chine profile shown, hollow rail 1621 includes multiple edges or "chines" that direct friction to a much smaller point of contact as compared to a more rounded or flat profile. Hollow rail 1621 with multi-chine profile 1600 further minimizes friction of the hollow rail 1621 in contact with ground or turf, thereby increasing club speed, and accordingly, increasing ball speed upon impact. Although illustrated as one hollow rail 1621 attached to sole 1605, a club head of the invention may include at least one hollow rail 1621, at least two hollow rails 1621, or greater than two hollow rails 1621, any one, some, or all of which may have a multi-chine profile 1600.

As shown, hollow rail 1621 is connected to sole 1605, and includes sidewalls 1623 and a base portion 1625 protruding a distance from the sole 1605 and including an exterior surface configured to directly contact ground when the club head including hollow rail(s) 1621 is held at address and resting on the ground. As shown, insert 1631 is entirely enclosed within the hollow rail 1621, although in other examples, insert 1631 may make up one or both entire sidewalls 1623 or at least a portion of one or both sidewalls 1623 of a hollow rail 1621.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments of the hollow rail, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents of the hollow rail.

What is claimed is:

1. A golf club head comprising:

a body defining a crown, a sole, a toe, a heel, and a ball striking face;

a hosel extending upwards from the heel side of the body when at address;

at least one hollow rail disposed on the sole, wherein the at least one hollow rail comprises a pair of opposing sidewalls extending from the sole and coupled to a base portion protruding a distance from the sole and including an exterior surface configured to directly contact ground when the club head is held at address and resting on the ground; and an insert provided within at least a portion of the at least one hollow rail, wherein the insert comprises a thermoplastic polymer, wherein the insert forms at least a portion of at least one of the pair of sidewalls.

2. The golf club head of claim 1, wherein the insert forms the entire sidewall.

3. The golf club head of claim 1, wherein the sidewall comprises an opening through which at least a portion of the insert is visible from an exterior of the golf club head.

* * * * *